United States Patent [19]

Warren et al.

[11] 4,204,798

[45] May 27, 1980

[54] AUTOMATIC SAWMILL

[76] Inventors: Lyle D. Warren, 500 Birch St., Sweet Home, Oreg. 97386; Robert W. Brewster, 5924 SE. McNary Rd., Milwaukie, Oreg. 97222

[21] Appl. No.: 846,893

[22] Filed: Oct. 31, 1977

Related U.S. Application Data

[62] Division of Ser. No. 644,571, Dec. 29, 1975, Pat. No. 4,074,601, which is a division of Ser. No. 434,903, Jan. 21, 1974, Pat. No. 3,960,041, which is a division of Ser. No. 190,589, Oct. 19, 1971, Pat. No. 3,811,487.

[51] Int. Cl.[2] ..... B27B 1/00

[52] U.S. Cl. ..... 414/750; 83/367; 83/435.1; 83/730; 144/312; 198/434; 198/485; 198/502

[58] Field of Search ..... 214/1 BB, 1 P, 1 PB, 214/146.5, 148; 198/434, 457, 485, 502, 750; 144/3 A, 3 B, 312, 209 A; 83/160, 280, 365, 367, 435.1, 730; 414/745, 748, 750

[56] References Cited

U.S. PATENT DOCUMENTS

| | | | |
|---|---|---|---|
| 1,824,381 | 9/1931 | Sörensen et al. | 83/364 X |
| 2,931,403 | 4/1960 | Parker | 214/1 BB |
| 3,007,500 | 11/1961 | Halicki et al. | 144/3 A X |
| 3,180,377 | 4/1965 | Pinder | 83/730 |
| 3,242,954 | 3/1966 | Schikofsky | 144/278 R |
| 3,459,246 | 8/1969 | Ottosson | 144/312 |
| 3,519,045 | 7/1970 | Blickenderfer et al. | 144/312 |
| 3,736,968 | 6/1973 | Mason | 144/3 R X |
| 3,747,455 | 7/1973 | Hartzell et al. | 83/435.1 X |
| 3,875,841 | 4/1975 | Noble et al. | 83/435.1 X |

*Primary Examiner*—L. J. Paperner

*Attorney, Agent, or Firm*—Klarquist, Sparkman, Campbell, Leigh, Hall & Whinston

[57] ABSTRACT

In an automatic sawmill, a caliper device measures the diameter of an incoming log and the log is then positioned against a pair of backstands over a log receiving carriage. A plurality of cutting devices are positioned relative to the carriage, and the speed control for the carriage is predetermined, in response to the log diameter. The diameter measurement is supplied to data processing circuitry which provides outputs indicative of "sets" to be taken by the aforementioned backstands and cutting devices for sawing the log into a number of cants, boards, or slabs in a manner making optimum use of the log content.

15 Claims, 24 Drawing Figures

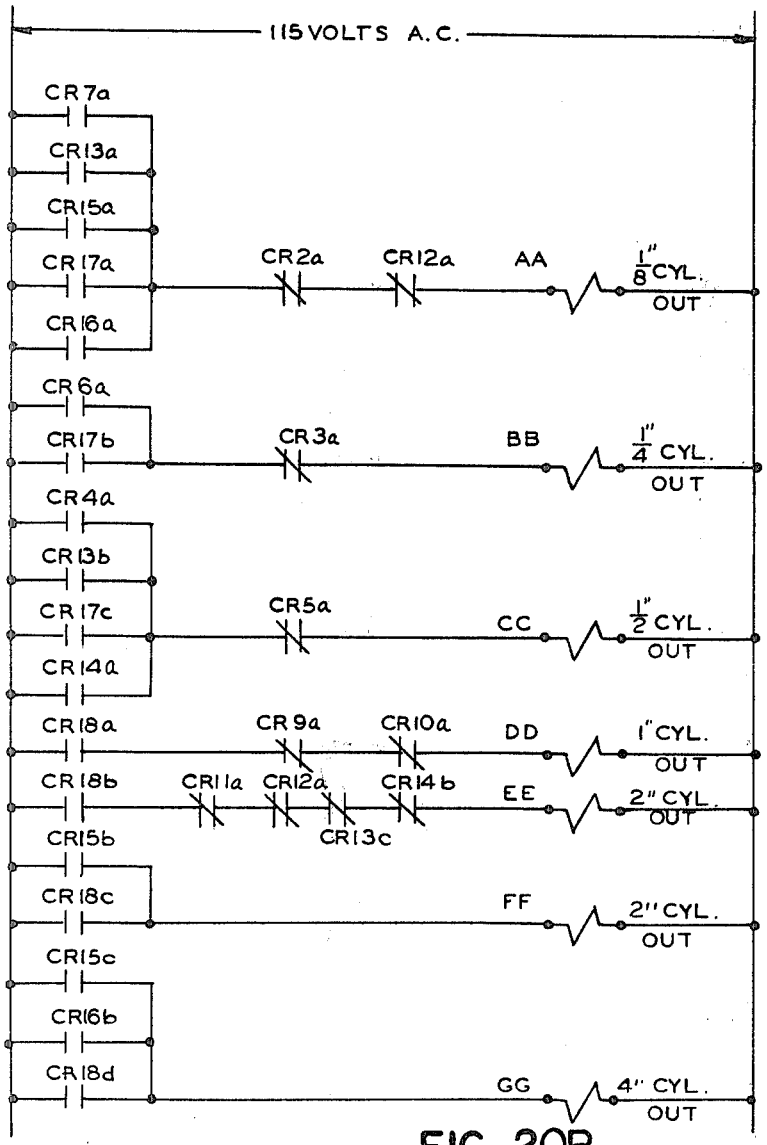
FIG. 19A
FIG. 20C
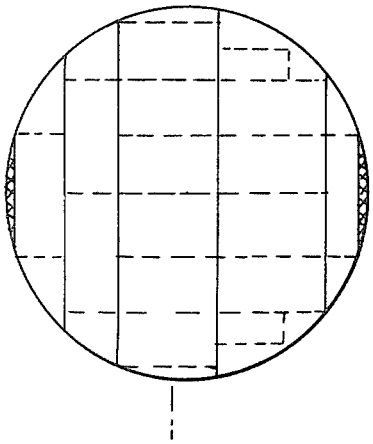
FIG. 20B
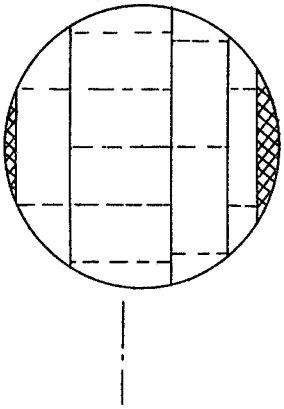
FIG. 20A
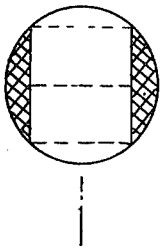

AUTOMATIC SAWMILL

This is a division of application Ser. No. 644,571, filed Dec. 29, 1975 (now U.S. Pat. No. 4,074,601) which is a division of application Ser. No. 434,903, filed Jan. 21, 1974 (now U.S. Pat. No. 3,960,041) which is a division of application Ser. No. 190,589, filed Oct. 19, 1971 (now U.S. Pat. No. 3,811,487).

BACKGROUND OF THE INVENTION

In sawmill operation, the sawing of a log is frequently accomplished in a number of stages according to the operator's best estimate of log size and the number of pieces of largest size which may be advantageously obtained therefrom. Decreasing timber stands require the most efficient use of the raw material, i.e. without the excessive waste heretofore occasioned, and also the desirability of providing lumber products at fairly low cost makes more efficient methods highly desirable. A more rapid and accurate system of sawing can be of particular importance in the case of smaller logs wherein a large number of logs must be handled in order to produce a reasonable output.

SUMMARY OF THE INVENTION

The present invention relates to an automatic sawmill and particularly to such a sawmill and method of operating the same wherein large quantities of raw materials are handled and the output in board feet and board size produced from each log is optimized.

According to an illustrated embodiment of the present invention, a sawmill having plural cutting means and a movable carriage receives a log on the carriage for travel through the aforementioned cutting means. The log is measured and in response to such measurement a plurality of cutting instructions are produced for cutting the log into a predetermined number and size of cants, boards, or slabs, these cutting instructions being effective to bring about transverse relative movement between the position of the log and the position of the cutting means.

In accordance with the preferred embodiment, the automatic sawmill includes a data processing circuitry which accesses "sets" for the cutting means and/or the log in automatic response to a diameter measurement of the log. The data processing circuitry desirably includes memory means including a sawing program most advantageous for any particular diameter log within predetermined limits.

A backstand method of cutting is preferred wherein one side of the log is aligned in parallel relation to the carriage center line or carriage movement through the cutting means, thus producing cants, boards, or slabs having faces parallel to the said one side of the log. The programing of the data processing circuitry is predetermined for making an optimum number of cuts starting substantially at a datum plane parallel to and proximate the said one side of the log.

In order to secure the positioning of the log with one side parallel to the carriage center line, while also positioning the log transversely with respect to certain cutting means, plural backstand means are utilized against which the log is transported by charger means movable in transverse relation to the carriage. Separate charger means are associated with separate backstand means so that aligning can take place, with the individual charger means being arrested in their forward movement as aligning is accomplished. After the log is correctly aligned with the forward side thereof parallel to the carriage, means on the carriage engage the log for carrying the same through the sawmill, and the aforementioned charger means are withdrawn.

It is accordingly an object of the present invention to provide an improved method and apparatus for automatically cutting logs into one or more cants, boards, or slabs.

It is a further object of the present invention to provide an improved method and apparatus for cutting logs into an optimum number of pieces, representing an optimum number of board feet, in response to measurement of the log size.

It is a further object of the present invention to provide an improved method and apparatus for rapidly receiving logs, measuring the same, and in response thereto automatically selecting sawmill "sets" as will provide efficient utilization of the log content.

It is another object of the present invention to provide an improved method and apparatus for utilizing the measurement of a log for accessing data processing circuitry to provide the optimum position of cuts to be made in the said log.

It is another object of the present invention to provide an improved method and apparatus for charging logs onto a sawmill carriage and engaging the said logs for movement through cutting means therefor.

It is a further object of the present invention to provide an automatic sawmill having improved data processing means responsive to log diameter for accessing the sawmill sets suitable for cutting the log into the optimum number and size of pieces.

It is another object of the present invention to provide an improved sawmill method and apparatus wherein a log is received and aligned relative to one side of the log in parallel relation to the sawmill center line, in its optimum position for securing the maximum product output from the log.

The subject matter which we regard as our invention is particularly pointed out and distinctly claimed in the concluding portion of this specification. The invention, however, both as to organization and method of operation, together with further advantages and objects thereof, may best be understood by reference to the following description taken in connection with the accompanying drawings wherein like reference characters refer to like elements.

DRAWINGS

FIG. 1 is an overall plan view or layout of an automated sawmill according to the present invention, FIG. 2 is a vertical cross-section of the FIG. 1 sawmill taken generally along line 2—2 in FIG. 1, but also including a full end view of a caliper device, FIG. 3 is a vertical cross-sectional view taken at 3—3 in FIG. 1, FIG. 4 is a partial plan view taken along 4—4 in FIG. 2, illustrating charger mechanism, FIG. 5 is a vertical cross-section also illustrating the charger mechanism and taken at 5—5 in FIG. 2, FIG. 6 is a partial illustration of a caliper device as seen along line 6—6 in FIG. 3, FIG. 7 is a cross-sectional detailed view taken generally at 7—7 in FIG. 3 illustrating guide means for a sawmill carriage dogging bar, FIG. 8 is a vertical cross-section taken at 8—8 in FIG. 1, and illustrating movable band mill and chipper head assemblies, FIG. 9 is a vertical cross-section taken at 9—9 in FIG. 1, illustrating an off-bearing roll portion of the sawmill, FIG. 10 is an elevational view of a hydraulic pump for controlling sawmill carriage movement, FIG. 11 is a vertical cross-sectional view of an alternative log charger apparatus, according to the present invention, FIGS. 12 and 12A are schematic or elementary diagrams of sequence control circuitry for the automated sawmill according to the present invention, FIG. 13 is a block diagram of data processing circuitry, according to the present invention, adapted to provide cutting instructions in response to log measurement, FIG. 14 is a detailed view of a first portion of the FIG. 13 coding matrix, such portion being associated with the right chipper head sets, FIG. 15 is a schematic diagram of a similar portion associated with left chipper head sets, FIG. 16 is a schematic diagram of yet another portion of the FIG. 13 coding matrix associated with left movable band saw sets, FIG. 17 is a schematic diagram of another similar circuit portion for providing right movable band saw sets, FIG. 18 is a schematic diagram for a coding matrix portion associated with speed control sets, FIGS. 19 and 19A are schematic or elementary diagrams for circuitry of the relay type incorporated in the aforementioned coding matrix for providing sawmill backstand sets, and FIGS. 20A, 20B, and 20C illustrate sawmill cuts provided for logs having diameters of 5½ inches, 9½ inches, and 13¼ inches, respectively.

DETAILED DESCRIPTION

Figure 1:
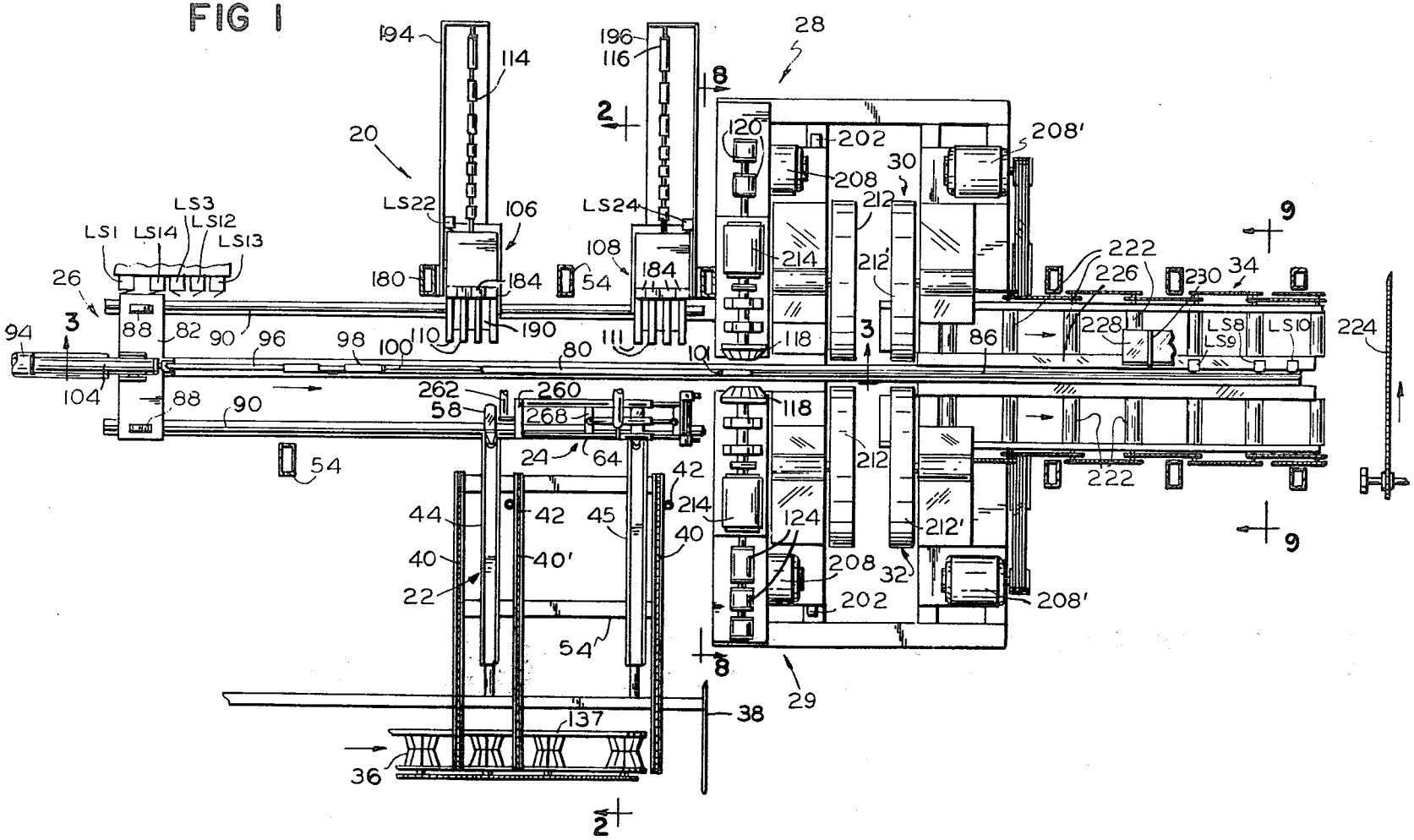

Referring to the drawings and particularly to FIG. 1 illustrating the general layout of an automated sawmill 20 according to the present invention, such sawmill includes carriage means 26 for receiving a log from log charger means 22, wherein the charger means is disposed at substantially right angles to the carriage path. The carriage travels upon wheels 84, 85, and 88 in a direction advancing a log carried thereby through left and right band mill and chipper head assemblies 28 and 29, as well as through left and right band mill assemblies 30 and 32 positioned along and on either side of the carriage path, for sawing the log.

A caliper device 24 is located adjacent the carriage and is used for measuring the diameter of the log prior to sawing, i.e. when the log is supported upon charger means 22, while a pair of backstands 106 and 108, located adjacent the carriage opposite the charger means, are employed to bring about proper alignment of the log relative to the carriage in accordance with the log diameter measurement. Data processing or computer type circuitry supplies the particular "sets" for the backstands, as well as chipper head and band mill positions and carriage speed for a particular log size, in such a manner as to saw the log into a number of cants, boards, and/or slabs making optimum use of the material in the log.

At the outfeed end of the chipper devices and band mills, an off-bearing roller assembly 34 is positioned for receiving the cut lumber. A sweep arm 136 removes the center cant after release thereof, toward the end of travel of the carriage.

Briefly considering operation of the mill, the caliper device 24 is remotely controlled for measuring the log diameter after the log has been delivered to the charger means 22. The measurements taken from the log are employed to address data processing circuitry which will then select the optimum positions for backstands 106, 108, as well as the optimum positions of the chipper heads and band mills. The charger apparatus carries the log forwardly until the log reaches the backstand means 106 and 108, at which time the forward movement of the charger apparatus is arrested, placing the forward side of the log in parallel relation to the center line of the mill, or parallel to the direction of subsequent travel of the log through the mill. The backstands are then automatically retracted while dogs 100 and 101 are operated to engage the ends of the log. Such engagement initiates retraction of the charger means 22, and when the charger is out of the way the carriage 26 moves to the right at the speed also determined in accordance with the calipered log diameter. The log is now cut, and a limit switch detects the end of travel for stopping the carriage and operating sweep arm 136. When the sweep arm has operated, return movement of the carriage is initiated and the charger apparatus may deliver another log thereto. It will be noted that another log can be calipered as the preceding log is being cut.

Figure 2:
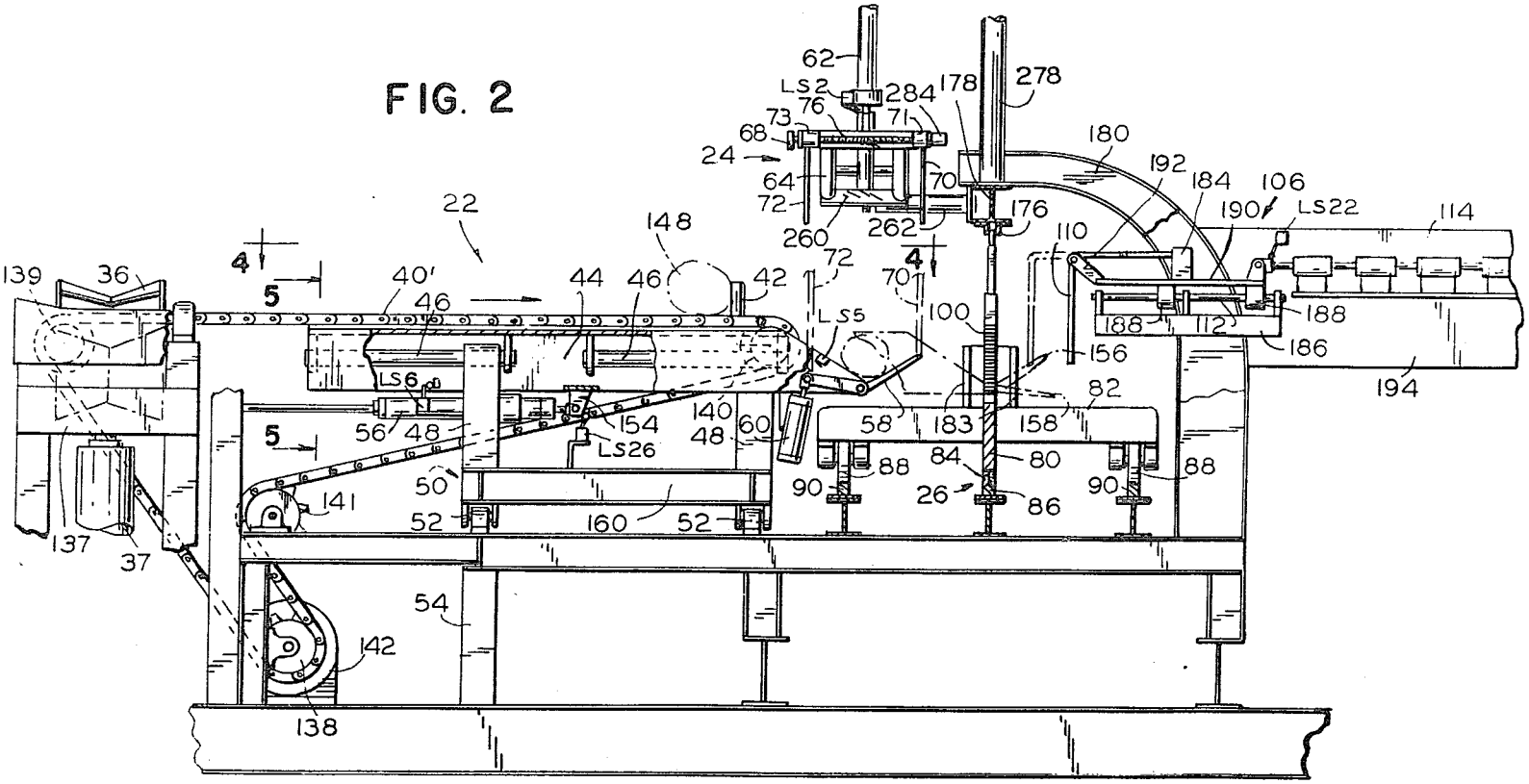
Figure 4:
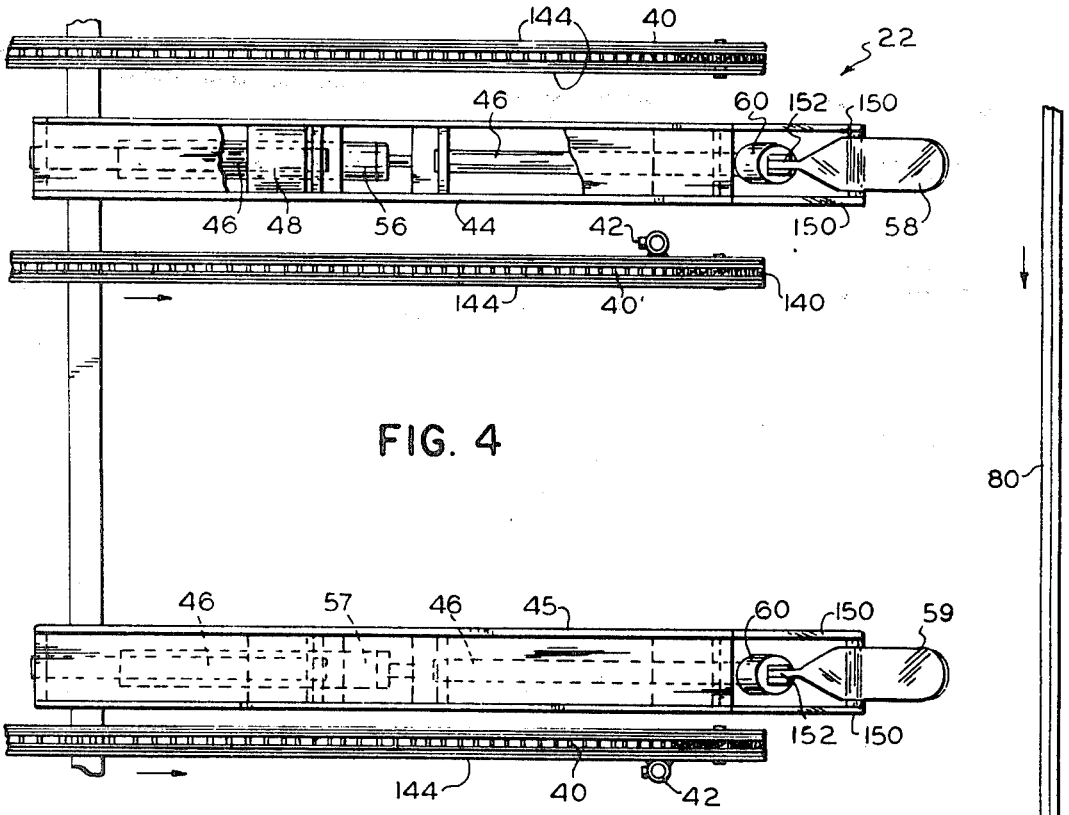
Figure 5:
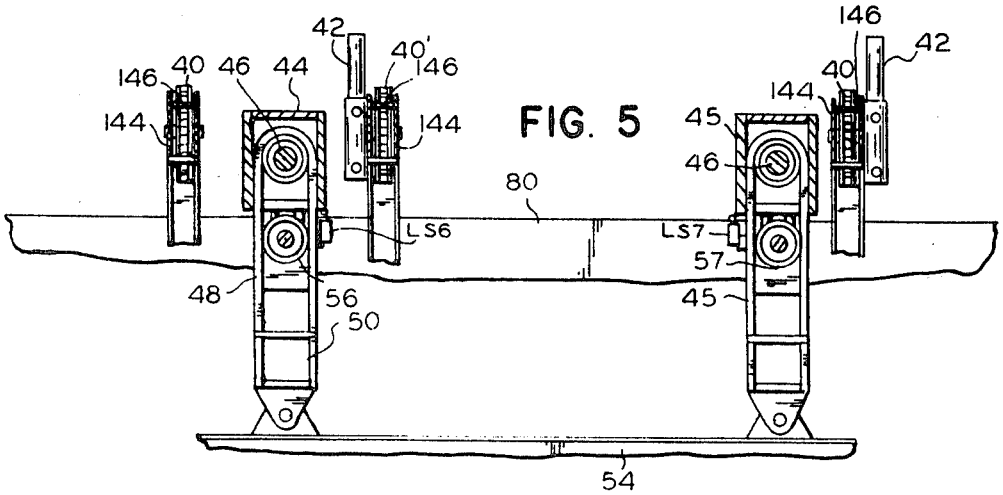

Considering the invention in greater detail with particular reference to FIGS. 2, 4, and 5, as well as FIG. 1, powered feed rolls 36 initially reside in the upper or full line position in FIG. 2, for receiving a log longitudinally thereupon. Each of the feed rolls comprises a ribbed, hourglass roller rotating at the same speed as the remaining rollers for transferring the log into the mill. The power drive to the rollers is manually controlled so that rotation may be discontinued when the log is in correct position over conveyor chains 40. Then, frame 137 carrying the feed rolls is lowered by means of air cylinder 37 for placing the log upon conveyor chains 40.

Each of the conveyor chains 40 suitably comprises a pintle chain, and the chains are interleaved with the structure of charger 22 so that a log may be carried over the charger structure and delivered to charger cradles 58 and 59. The chains also interleave rolls 36 whereby a log can be deposited upon the chains from rolls 36 as hereinbefore mentioned. The center chain 40′ as viewed in FIG. 2 is supported upon sprockets 138, 139, 140, and 141 journaled in bearings secured to the main frame 54 of the mill, with sprocket 138 suitably being driven by a drive shaft from motor 142. The corresponding sprockets for the remaining chains are similarly driven from the same drive shaft. The upper chain courses are received in chain guides 144, each provided with a shelf 146 upon which the upper runs of the chains may slide. The head end sprocket 140 is located immediately adjacent the tapered forward ends of charger beams 44 and 45 which pivotally carry log receiving cradles 58 and 59. One or more logs, e.g. as illustrated at 148, are received upon chains 40 but are prevented from initial transfer onto the charger cradles by means of air-operated pin stops 42. Thus, a plurality of logs may be disposed upon the chains 40, and the chains operated in conjunction with the pin stops for depositing one log at a time upon the cradles 58 and 59. As the pin stops 42 are dropped, and the conveyor chains energized, a log can be moved off the head end conveyor sprockets and along the tapered forward edges 150 of charger beams 44 and 45, onto the aforementioned cradles.

Each cradle comprises a steel plate horizontally pivoted between the sides of one of the charger beams. The cradles are respectively provided with control arms 152 operated by means of air cylinders 60 trunnion supported from the respective charger beams. The air cylinders 60 are adapted for positioning the cradles 58 and 59 either in a substantially horizontal position, or in the uptilted position as illustrated in FIG. 2 for catching a log delivered thereto.

The charger beams 44 and 45 are characterized by a box-like construction and are internally provided with longitudinal rods 46 which are slideable within cylindrical openings in upright supports 48. Hydraulic cylinders 56 and 57 extend through the upright supports 48 and are supported thereupon, while operating rods therefor are connected to brackets 154 depending from the charger beams. As thus appears, the charger beams are slideable with respect to the vertical supports 48 from the position illustrated in FIG. 2 to a position to the right thereof. Actuation of hydraulic cylinders 56 and 58 enables movement of the cradles toward backstands 106 and 108, e.g. to a position which would place a log between carriage dogs 100 and 101 as illustrated in dashed lines at 156 in FIG. 2. After subsequent engagement of the log by dogs 100 and 101, the cradles may be dropped to the position illustrated in dashed lines at 158 in FIG. 2, e.g. a substantially horizontal position, through operation of air cylinders 60 so that the charger beams may be withdrawn to the left. As hereinafter more fully indicated, the log is not in most cases centered between dogs 100 and 101, but this positioning for the cradles is merely illustrative. The charger beams are actually driven to the right until the log carried by the cradles makes full contact with fingers 110 and 111 of backstands 106 and 108, respectively, in accordance with the desired cut programing for the particular log. After contact, the movement of the charger beams toward the backstands 106 and 108 is arrested as hereinafter more fully explained.

A horizontal beam member 160 joins upright supports 48 for a given charger beam to provide a unitary structure or charger frame 50. The charger frame 50 is pivotally supported upon the main frame 54 by means of bearings 52. Each charger frame is thus independently tiltable in a direction perpendicular to the direction of charger beam movement, or substantially in the longitudinal direction of the carriage, while the charger frames are maintained in their substantially upright position employing spring suspension means including shock absorber means (not shown) so that only a limited horizontal movement is permitted. When a log is received upon charger cradles 58 and 59, and the charger beams transfer the log to a position between dogs 100 and 101, the engagement or dogging of the log can produce undesirable stresses in the cradles 58 and 59 when, for example, a knot or branch extending from the surface of the log catches one of the cradles 58 or 59, or part of the charger beams. For this reason the charger frames are allowed to move in the direction of the log in a limited manner. After the cradles 58 and 59 are dropped, through operation of air cylinder 60, and the charger beams are withdrawn, the charger frames return to their substantially upright position.

Figures 3, 6, 7:
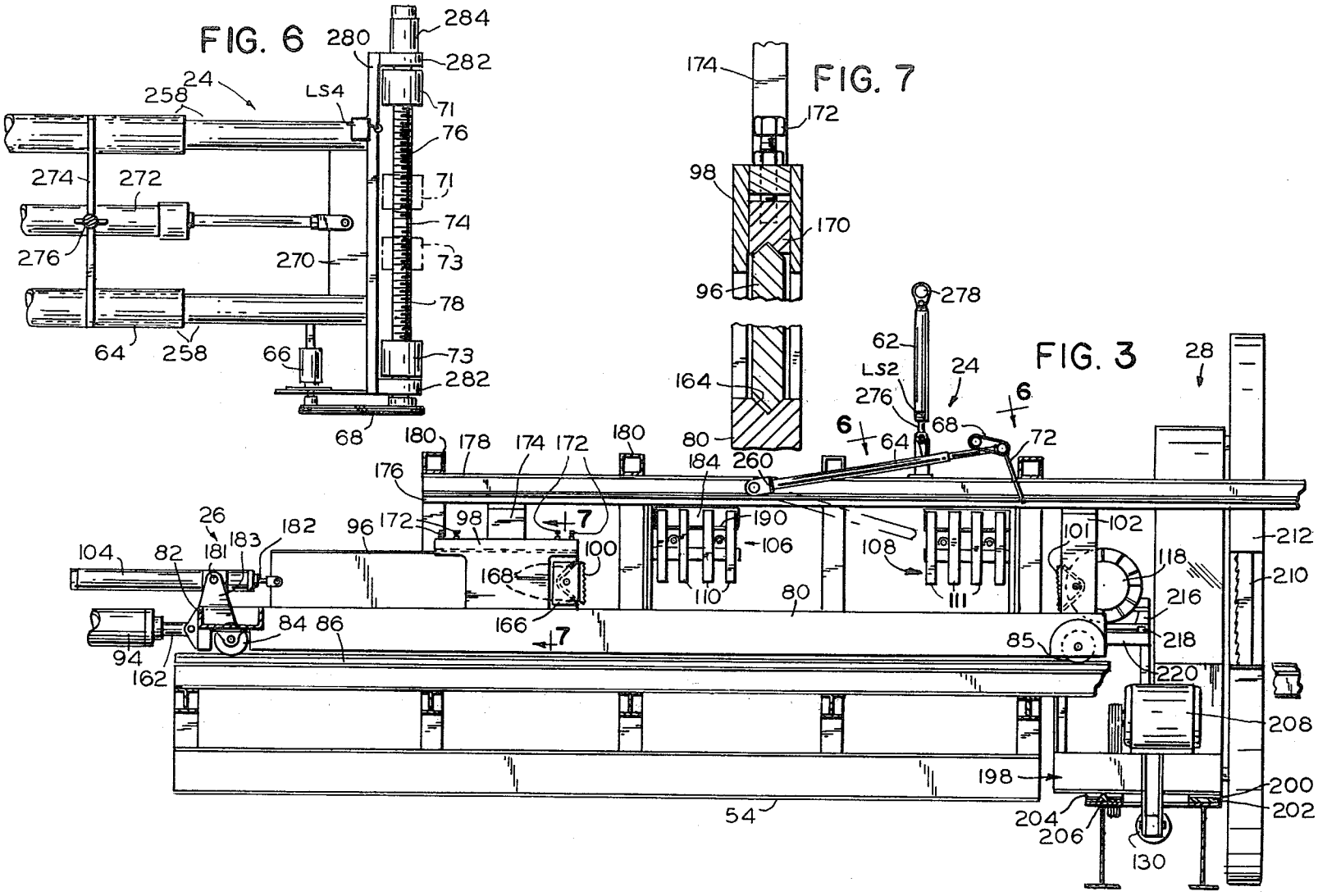

Referring particularly to FIGS. 2 and 3, as well as to FIG. 1, carriage 26 comprises a narrow elongated steel beam 80 having a cross member or head end member 82 welded thereto completing a T configuration. The head member 82 of the carriage is provided with support wheels 88 which travel along flat rails 90, and a central V-shaped guide wheel 84 which travels along V-rail 86. At the opposite end of the carriage, beam 80 is supported by a second guide wheel 85, also V-shaped, which rolls along rail 86. A long hydraulic cylinder 94 has its operating rod pivotally secured to the head end of carriage beam 80 and is adapted for propelling the carriage in a left to right direction in FIGS. 1 and 3 whereby a log carried by the carriage will be urged through the band mill assemblies 28, 29, 30, and 32. The hydraulic cylinder 94 is therefore quite elongated to provide for piston movement corresponding to desired carriage movement, with the opposite end of cylinder 94 being attached to mill framework.

The top of carriage beam 80 is provided with a machined V slot 164 (see FIG. 7) along which a dogging bar 96 slides, such bar carrying a pivotally mounted dog having hardened teeth for engaging the end of log. The dog 100 narrows towards its pivot point and is received between side plates 166 welded to the dogging bar. Springs 168 maintain the tooth face of the dogging bar in a substantially vertical position, but allow some pivotal movement thereof in a vertical plane when the dog engages a log.

Secured upon beam 80 is a guide assembly 98 having a V-shaped shoe 170 for engaging the top of dogging bar 96 and maintaining the same in a vertical attitude. The shoe 170 is provided with top adjusting screws 172 provided with lock nuts and employed for the purpose of the vertically adjusting shoe 170 so that slideable contact is provided between the shoe and the dogging bar. Since the carriage itself moves in a longitudinal direction, carrying the assembly 98 therewith, a top extension 174 is secured thereto which rides in a longitudinal guide 176 positioned along the lower side of I-beam 178 depending from mill arches 180 above the carriage path.

An air cylinder 104 is mounted by means of trunnions 181 between supports 183 extending upwardly from the head member 82 of the carriage 26. The operating rod 182 of this air cylinder is pivotally connected to the head end of the dogging bar 96 for forcing the dogging bar to the right when a log is to be engaged, i.e. after a log is correctly positioned between dogs 100 and 101 upon cradles 58 and 59 of the charger. Dog 101 is pivotally supported upon an upright 102 welded to the right hand end of carriage beam 80 above wheel 85, and is urged to the vertical position by a pair of springs in substantially the same manner as was discussed with respect to dog 100.

The log is charged onto the carriage with respect to backstands 106 and 108 which are movable toward and away from the carriage and hence toward and away from the charger apparatus. Each backstand includes a plurality of vertically disposed log contacting fingers. Thus backstand 106 includes four log contacting fingers 110, while backstand 108 includes four log contacting fingers 111, wherein each such finger is pivoted for operating a switch 184 when contact is made with a log.

Referring to FIG. 2, backstand 106 is illustrated from the side and includes a horizontal support 186 carrying horizontal guide rods 112 upon which horizontal guides 188 slide. A plate 190 attached to guides 188 carries switch 184 and a pivot arm 192 at the forward end thereof to which fingers 110 are pivotally secured. Each of the fingers has an L-shape to provide the downwardly extending log contacting portion as well as a horizontally extending lever arm for operating a switch 184. The fingers are formed of relatively flexible material which will bend somewhat within the elastic limit for actuating a switch 184 without becoming damaged by log contact. As will hereinafter more fully appear, a plurality of fingers with a corresponding plurality of switches are utilized for each backstand in such a manner that all of the switches in a backstand must be operated before charger movement is arrested. This cooperation of the backstand fingers provides a true indication of the side of the log presented thereto, while ignoring knots or small protrusions which might give an incorrect indication of the log side if only one backstand finger were to be employed.

Also associated with each backstand is a setworks numbered 114 in the case of backstand 106, and numbered 116 in the instance of backstand 108. Each such setworks comprises a plurality of air cylinders disposed in serial fashion whereby the total movement produced equals the total operating rod extension or movement of the individual cylinders. Thus, each cylinder is provided with one or two operating rods which are connected to the operating rod or cylinder next in line. Each cylinder is double acting in response to a pneumatic control (not shown) for placing each cylinder in the operating-rod-in or the operating-rod-out position. Setworks for other purposes are well known in the art and need not be described in further detail. In the instance of each backstand, the series of air cylinders 114 and 116 are supported by frames 194 and 196 respectively. Each of the setworks comprises seven cylinders having a piston throw of ⅛ inch, ¼ inch, ½ inch, one inch, two inches, two inches, and four inches, respectively. These cylinders, when actuated, are capable of providing the corresponding movements toward the sawmill center line and combinations of these cylinders, when actuated, will be capable of moving the backstand in one-eighth inch increments towards the center line of a sawmill. When the backstand is moved to the desired position, and the charger moves theretoward with a log which contacts the backstand fingers disposed at such position, actuation of the corresponding switches 184 will shut off the supply of hydraulic fluid to the hydraulic cylinder 56 or 57 of the charger so that the log will remain in position where the backstand fingers are contacted. The backstands are moved inwardly and outwardly together from a common reference line parallel to the center line of carriage beam 80, and hence the forward side of the log will be parallel to the center line of the sawmill carriage beam 80.

It should be emphasized that the two charger mechanisms operate substantially independently from one another for accomplishing placement of the forward side of the log in parallel relation to the center line of the sawmill. For this reason, each charger beam has associated therewith one of the backstands directly opposite thereto which controls the charger movement. Thus, charger beam 44 and cradle 58 are substantially opposite backstand 106, while charger beam 45 and cradle 59 are substantially opposite backstand 108. Before movement of the charger bearing a log toward the carriage, both backstands 106 and 108 are moved towards the carriage by a like amount whereby fingers 110 and 111 are disposed in parallel relation to the carriage. The log, however, will generally be tapered and consequently the larger diameter end of the log will ordinarily contact backstand fingers before the smaller diameter end of the log. In the instance of the specific embodiments illustrated, barked logs were cut eight feet long and generally disposed (by means not shown) with the smaller end in cradle 59. Then, when charger cylinders 56 and 57 are actuated, and the log is moved forwardly, fingers 110 of backstand 106 will be reached by the log before fingers 111 of backstand 108. It is realized this need not be the case if different amounts of hydraulic fluid are provided to the cylinders, but this example is employed for purposes of illustration. When backstand fingers 110 operate their corresponding switches, hydraulic cylinder 56 is stopped. A short time later when the smaller end of the log contacts fingers 111, movement of hydraulic cylinder 57 is similarly arrested, placing the forward side of the log (that is the side towards the backstand) in parallel relation to the mill center line. It is understood the same end result obtains if the charger cylinders do not move at the same rate and if, for example, the smaller end of the log were to reach the corresponding backstand first.

Figure 8:
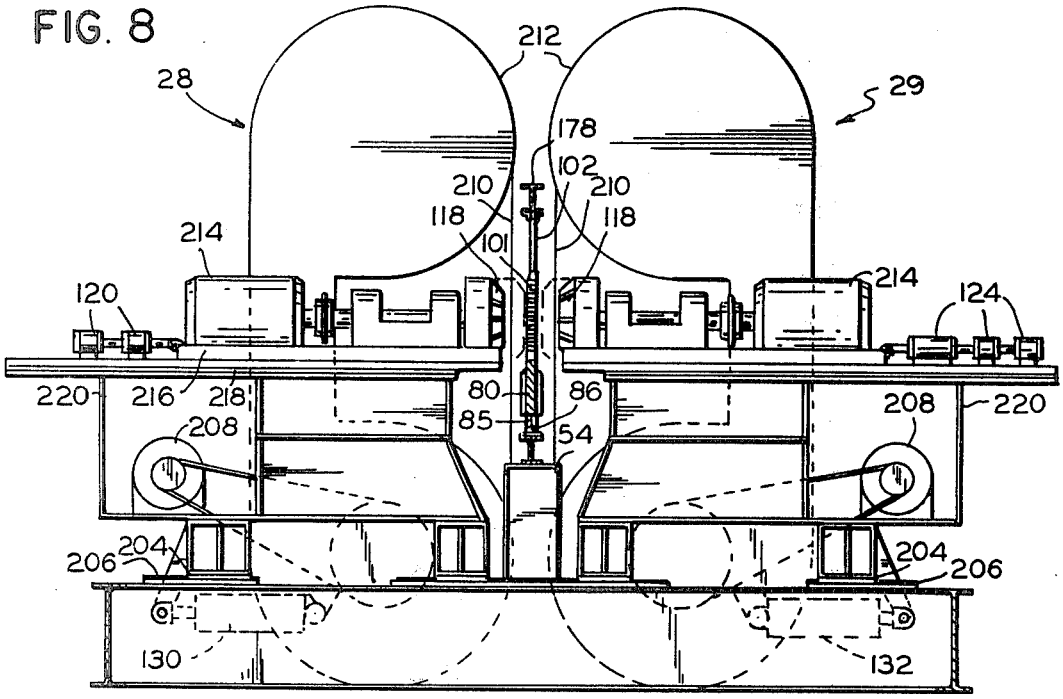

The carriage during loading is substantially stationary and at the left hand extremity of its travel path, but after the log is dogged by operation of air cylinder 104, producing engagement of the log between dogs 100 and 101, the carriage is moved to the right for carrying the log through band mill and chipper head assemblies 28 and 29, as well as band mills 30 and 32, wherein the log is cut into the desired number of pieces. Considering first the band mill and chipper head assemblies 28 and 29, as illustrated in FIGS. 3 and 8, as well as FIG. 1, each said assembly comprises a band mill husk 198 slideable toward and away from the center line of the mill. Each husk is provided with a flat skid 200 mounted on a flat rail 202 extending in a direction perpendicular to the mill center line and supported on structure therebeneath. Parallel to skid 200, a V-shaped skid 204 is mounted upon husk 198 for cooperating with V-shaped guide rail 206. Each band mill husk carries a motor 208 adapted for driving a band saw 210 within guard 212 via a conventional driving system. The band saw is disposed in a plane parallel to the center line of the sawmill in the proper position for making the desired saw cut and is supported in a conventional manner from husk 198. The husk for assembly 28 is moved inwardly and outwardly toward the mill center line by means of a setworks 130 similar to the setworks hereinbefore discussed but comprising a single cylinder having a two inch throw. Similarly, right hand assembly 29 is movable toward and away from the sawmill center line through actuation of setworks cylinder 132 also having a two inch throw. Consequently, each band mill is movable between separate "in" and "out" positions which will be hereinafter defined in greater detail. Thus the band saws associated therewith are movable inwardly and outwardly to desired positions with respect to the mill center line.

Also supported upon each husk 198 is a chipper head 118 driven by a motor 214. These chipper heads are disposed at right angles to the center line of the mill while the motors and bearing supports therefor are each mounted upon a frame 216 slideable along nylon skids 218 upon sub support 220 of the sawmill husk 198. Thus, the chipper heads move with respect to the sawmill husk, which itself is movable inwardly and outwardly toward and away from the mill center line. The left hand chipper head is caused to move inwardly and outwardly with respect to a supporting band mill husk by means of setworks 120 comprising a pair of air cylinders each having a one and $\frac{7}{8}$ inch throw. The right hand chipper head is movable inwardly and outwardly on its supporting sawmill husk under the control of setworks 124 comprising air cylinders respectively having a $\frac{7}{8}$ inch throw, a one inch throw, and a two and $\frac{3}{4}$ inch throw.

In the present embodiment, the band mills 30 and 32 are substantially similar in construction to the movable band mills just described, and similar elements are referred to in the drawings by means of primed reference numerals. The band mills are again located on skids as a matter of convenience for positioning the band saws relative to the mill center line in the proper cutting position, but no setworks were employed in this particular embodiment for selectively locating the band saws in different positions. Hence, band mills 30 and 32 will be referred to as fixed band mills, which, in the instance of the present embodiment, were disposed to provide a cut of a nominal two inches from the center line of the mill. Thus, in the embodiment described, a center cant is provided having a nominal four inch thickness as the log passes between the fixed band mills 30 and 32. It is understood that carriage beam 80 and the rail structure therebeneath for supporting the same is narrow enough to pass between band saws 210' of band mills 30 and 32. Generally speaking, the positions of the band mills and chipper heads of assemblies 28 and 29 will be at a greater distance from the mill center line in order to cut board thicknesses on either side of the center cant, except in the case of logs of small diameter.

In the case of the fixed band mills, the band saws are positioned on the reverse side of the band mill husk from the band mill positions on the movable assemblies. Thus, the fixed band saws are located adjacent the movable band saws, and immediately thereafter along the center line as one proceeds along the center line of the mill.

Figure 9:
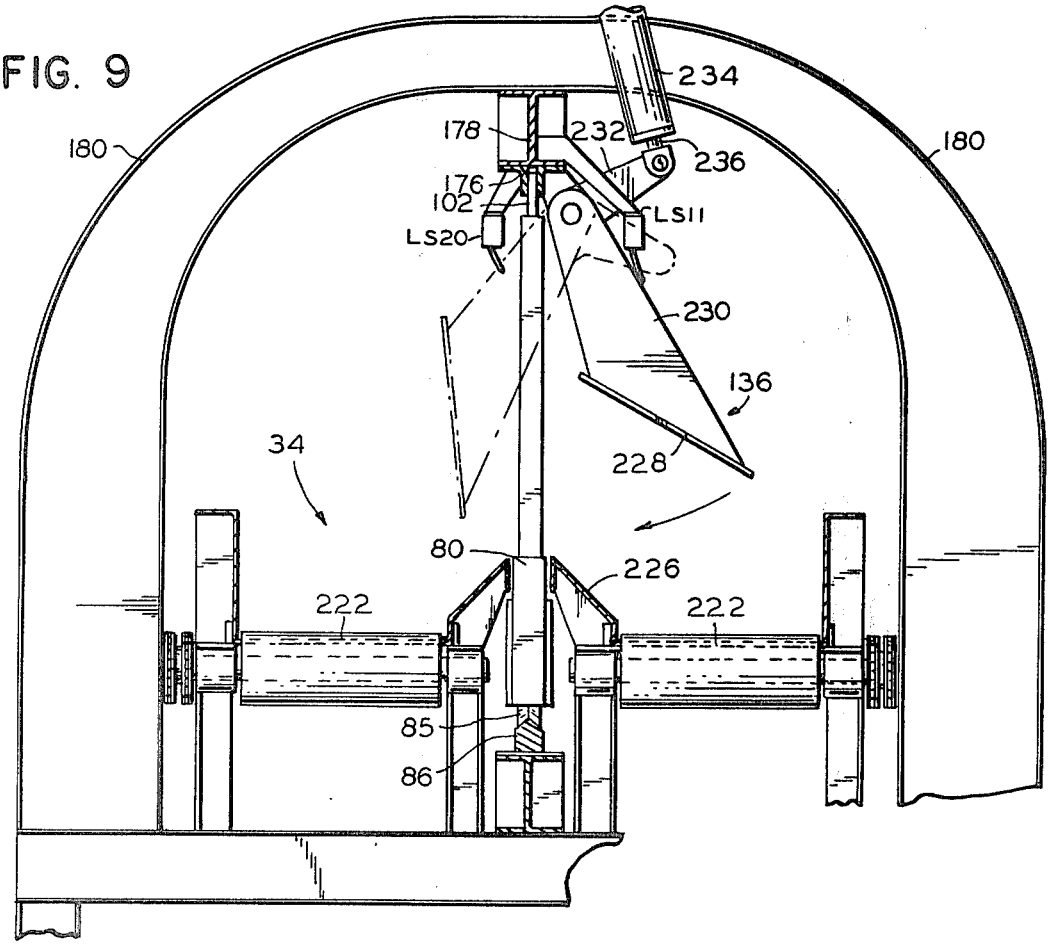

After the log has passed through both movable band mill and chipper head assemblies, as well as both fixed band mills, i.e. after dog 100 has passed between the band saws of the fixed band mills, the side boards or slabs fall upon powered rollers 222 of off-bearing roller assembly 34 by means of which the same are delivered to a right angle chain conveyor partially indicated at 224 in FIG. 1. Skirts 226 on either side of carriage beam 80 direct the boards as well as the center cant onto the off-bearing rollers. As the carriage moves to the right, deceleration thereof takes place, and dog 100 is moved away from the center cant so the center cant may also be dropped onto the off-bearing rolls. To insure removal of this center cant before the carriage moves back toward the head end of the mill, a sweep arm 136 is employed for urging the center cant or any other lumber off the carriage track. The sweep arm 136 includes a striking plate 228 located at the lower end of arms 230 pivotally supported from the mill structure for rotation about an axis parallel to the mill center line. Crank 232 secured to arms 230 is operated by air cylinder 234 secured to the mill structure, the cylinder having an operating rod 236 pivotally connected to crank 232. The operating rod 236 is normally withdrawn upwardly by the cylinder so the striking plate 228 remains clear of the carriage track during carriage movement. However, when the carriage reaches its right hand position, cylinder 234 is operated for swinging the striking plate 228 across the carriage for removing any remaining wood as described. The striking plate is then upraised again and the carriage drive is reversed for returning the carriage to its position at the head end of the mill for receiving another log. The sweep arm and the off-bearing roll assembly are seen in FIG. 9 as well as in FIG. 1.

As hereinbefore mentioned, the speed of carriage travel is variable and predetermined, and moreover the direction of carriage travel is reversed after each pass through the mill so the carriage may return to a position for receiving another log. The carriage is moved along its path by means of hydraulic cylinder 94 located at the head end of the carriage and this cylinder is driven by means of a variable displacement pump, both in the case of forward and backward movement directions for the carriage. This variable displacement pump provides hydraulic fluid at the proper rate and in the proper direction for correctly controlling carriage movement. The variable displacement pump employed in the case of the present apparatus was a Sundstrand pump, Model 23, manufactured by the Sundstrand Company at Rockford, Ill., and of the type having a "swash plate" which moves over center to provide reversing action. This pump is illustrated at 239 in schematic form in FIG. 10. The pump is provided with a control handle 238 adapted for controlling the rate of flow and direction of flow of hydraulic fluid in lines 240 and 242 which are connected to either end of carriage drive cylinder 94 in a conventional manner. The output of the pump will be responsive to the position of control handle 238 so long as solenoid actuated dump valves 244 and 246 are closed, these valves having been added to the otherwise standard pump. When dump valves 244 and 246 are opened, hydraulic control fluid which permits control of the pump 239 by control handle 238 is drained to hydraulic fluid tank 248.

The pump 239 includes plural pumping cylinders which are motor driven through a rotatable "swash plate" the angle of which is determined by a pair of control cylinders, schematically illustrated at 250 and 252. These control cylinders are normally operated in response to control handle 238 in correct proportion to position the swash plate whereby the pumping cylinders pump oil at the rate determined by the control handle 238. However, when it is desired that the pump be rendered inoperative, the hydraulic control fluid is drained as described above.

The control handle 238 is positioned by means of setworks 254 supported from framework 256 and suitably having piston movements in the ratio 4/4/3/2/1. It is understood the exact linear movement provided can be adjusted in accordance with the desired speed and the length of control handle 238. Operation of the setworks cylinders in various combinations is adapted to provide control handle positions of neutral, forward speeds of 80, 100, 120, 140, 160 and 180 feet per minute, and a predetermined reverse speed suitably in excess of 180 feet per minute.

The forward speed setting for the sawmill carriage as well as the backstand setting, and settings of the left and right chipper heads and left and right movable band mills are determined in accordance with the size of the log being sawed. For this purpose, the log is measured in diameter before it is moved toward the backstands for engagement between dogs 100 and 101. According to the present embodiment, a caliper device 24 is employed for measuring the diameter of the log as the log resides across cradles 58 and 59 prior to movement of said cradles toward the backstand and sawmill carriage.

The caliper device 24 comprises a frame 64 formed of parallel telescoping rods 258 joined at their upper ends by cross member 260. A support arm 262 extending from beam 178 pivotally engages the cross member 260 whereby the caliper frame 64 may move upwardly and downwardly. The pivot point is substantially above and has an axis perpendicular to the pivot axis of cradles 58 and 59 therebelow whereby the frame 64 can be lowered and raised vertically with respect to a log supported by the cradles.

The frame 64 further includes cross members 268 and 270 located respectively across inner and outer sections of the telescoping rods 258 and having an extending cylinder 272 therebetween adapted to adjust the degree of rod telescoping desired. A further cross member 274 joining the outer telescoping rods is pivotally connected to the operating rod 276 of an air cylinder 62, the latter being pivoted to an overhead support post 278 joined to the beam 178. Operation of the cylinder 62 raises and lowers the frame 64 with respect to cradles 58 and 59.

Secured to cross member 270 is a plate 280 carrying a pair of bearing members 282 at ends thereof between which is journaled a threaded rod 74. Threaded rod 74 includes left hand threads 76 on the left hand side of the center, and right hand threads 78 on the right hand side of center, and is rotated by means of an air motor 66, supported from the frame, via a drive chain 68. The threaded rod 74 carries first and second threaded caliper arm supports 71 and 73 having left hand and right hand threads respectively for engaging corresponding threaded parts of rods 74. Depending from caliper arm supports 71 and 73 are vertical caliper arms 70 and 72 which are adapted to engage the outside of the log. At the end of the threaded rod opposite from the air motor, a cam switch 284 is positioned which is operated twice for each revolution of the rod 74. Thus, cam operated contacts close cam switch 284 twice for each revolution of the rod.

In operation of the caliper device, the caliper frame 64 is dropped towards a log by operation of air cylinder 62 with the caliper arm 70 and 72 in their outermost position. Air motor 66 is then started whereby threaded rod 74 turns, driving caliper arm supports 71 and 73 toward one another. When the caliper arms 70 and 72 are a little more than sixteen inches apart, limit switch LS4, disposed on the caliper frame, is actuated and, thereafter, the closings of the contacts of switch 284 are counted until the caliper arms encounter the log. It can be seen that the number of switch closings are an inverse function of the log diameter. After the log has been measured, the calipering device frame is withdrawn upwardly employing air cylinder 62, and the charger beams may be moved forwardly from positioning the log in accordance with the measurement. Other calipering means and charger means can be substituted as hereinafter more fully described.

Figure 13:
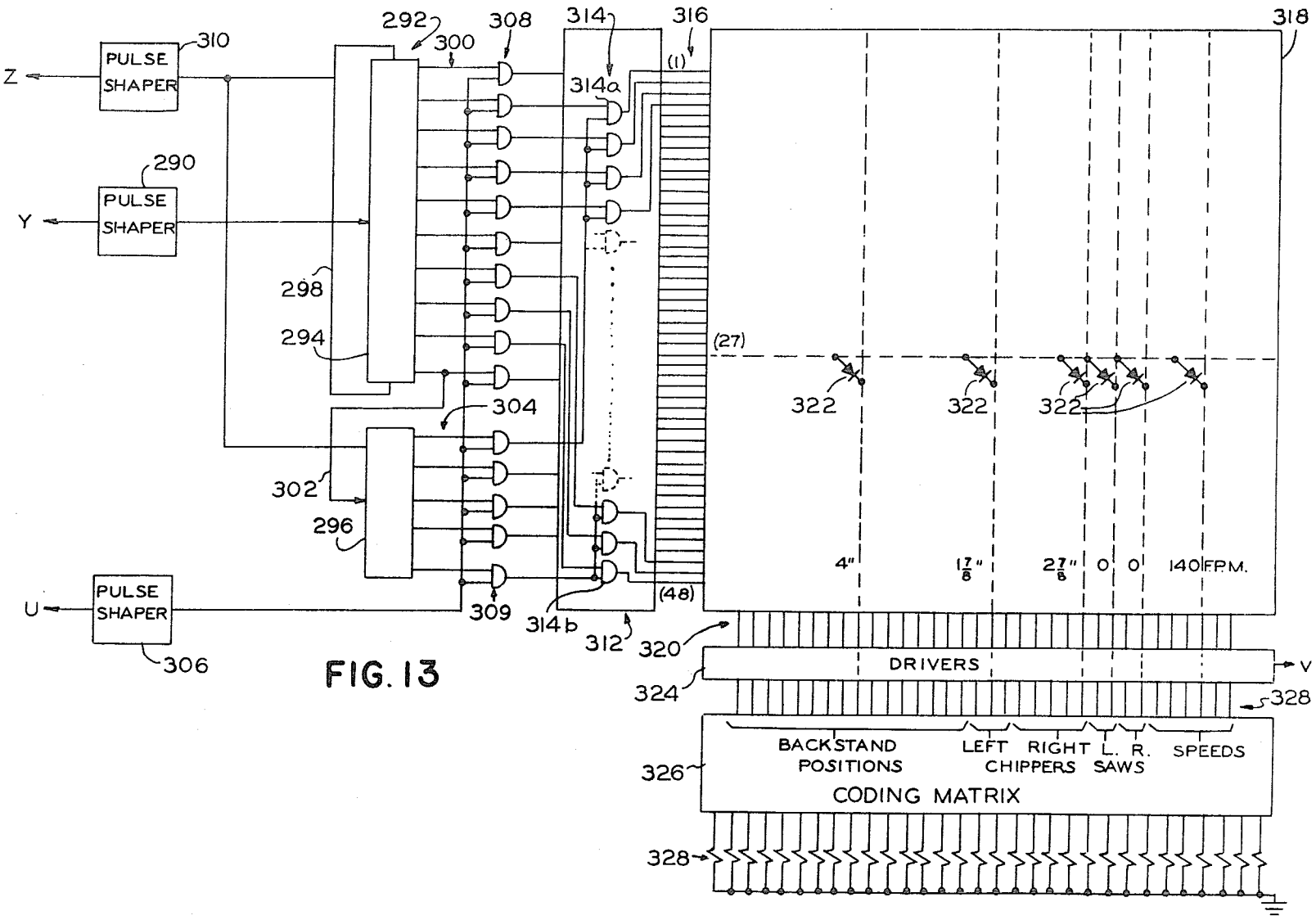

Referring now to FIG. 13, data processing circuitry is illustrated, in block diagram form, for receiving the log diameter measurement from a caliper device and providing a plurality of "sets" for the backstand setworks, the left and right chipper head setworks, the left and right movable band saw setworks, and the speed control setworks. An input signal Y is received from the caliper device, via control circuitry hereinafter more fully described, from switch 284 on the caliper device. This input signal consists of a pulsation for each eighth inch movement of head 71 after the same operates limit switch LS4. The threaded portions 76 are identical in screw lead and consequently a pulsation will be produced for each total caliper arm relative movement of one quarter-inch. As hereinbefore mentioned, the pulsations are received after limit switch LS4 is operated at which point the caliper arms 70 and 72 are slightly more than sixteen inches apart. Thus, if the log being calipered has a diameter of sixteen inches, one output pulsation will be produced. If on the other hand the log diameter is fifteen and three-quarter inches, two output pulsations are produced and so on, down to and including forty-eight pulsations for a log diameter of four and one-quarter inches, which is, in general, the smallest diameter log acceptable to the mill embodiment disclosed herein.

The input Y is applied via a pulse shaper 290 to counting means 292 comprising a first ring counter 294 for digits 0 through 9, and a second counter 296 for digits 0 through 4. Counter 294 suitably comprises a plurality of flip-flop stages connected in serial fashion whereby an input from pulse shaper 292 causes transfer of an active output from one of counter output leads 300 to the next. Thus, if the counter 294 is in the zero or reset stage, the top lead of leads 300 is activated, and for each ensuing pulsation received from pulse shaper 290, the next output lead downwardly in line is activated, only one output lead being "up" at any time. Register circuitry of this type is well known by those skilled in the art and need not be described as regards internal wiring.

The output stage of counter 292 is returned to the input stage via lead 298 completing a ring counter configuration. Thus, after nine inputs from pulse shaper 290, the bottom output lead 300 will be activated, but the next input from pulse shaper 290 will produce an output once more at the topmost output lead 300 of counter 292. At the same time, counter 296 will receive an input via lead 302 causing the active output from counter 296 to shift from the topmost output lead 304 thereof to the next output lead in order. It will be seen that the number of input pulses at terminal Y will be represented in decimal fashion by the output positions of counters 294 and 296 wherein the output of counter 296 describes the "tens" digits of the total, while the output position of counter 294 describes the "units" digits of the output total. The output leads 300 of counter 294 are respectively connected as inputs to and-gates 308, while the output leads 304 of counter 296 are similarly connected to and-gates 309. After the total pulsations from terminal Y, inversely representative of the log diameter, have been counted, as enabling input U will be applied via pulse shaper 306 to the series of and-gates 308 and 309 for energizing the same and providing the pulse output count as the output leads of such and-gates. At a subsequent time, the counting means 292 is reset by an input Z received via pulse shaper 10. The origins of inputs U and Z will be hereinafter more fully described.

The outputs of and-gates 308 and 309, consisting of one output from the top ten gates 308 and one output from the lower five gates 309, will be applied to a matrix driving circuit 312 which comprises a further plurality of and-gates 314 each having two inputs, one being connected to the output of one of the gates 308, and the other being connected to one of the outputs of gates 309. The gates 314 have their inputs connected in this manner for all numerical combinations of counter summations from one through forty-eight, indicative of log diameters from sixteen inches down to four and one-quarter inches, in quarter-inch increments. Thus, gate 314*a* receives a "one" input from the units counter 294 (via the appropriate gate 308) and a zero input from tens counter 296, and provides an output indicated at (1) in FIG. 13, providing both its inputs are up. Gate 314*b* receives an eight input from units counter 294 and a four input from tens counter 296 and produces an output labeled (48) in FIG. 13, if both its inputs are up. One such and-gate is employed for each numerical count from one through forty-eight whereby only one of the output leads 316 will be energized for any one log diameter.

The output leads 316 are applied to a decoding matrix or memory matrix 318 comprising a multiplicity of diodes connecting certain cross leads for selectively energizing output leads 320 thereof in response to an input from one of the leads 316. This memory matrix selects the positions or "sets" for the various movable elements in accordance with the log size calipered. The connections are indicated for one particular log size, this input being numbered (27) representative of the number 27 from counter means 292 or 27 pulses received from pulse shaper 290. This corresponds to a measured log diameter of nine and one-half inches. The input labeled (27) accesses the desired position or sets of the backstands, chipper heads, band saws, and the desired speed. In the particular instance of the nine and one-half inch log given, the bandstand set desired is four inches, the left hand chipper head set is one and seven-eighths inches, the right hand chipper head set is two and seven-eighths inches, the left hand band mill set is zero inches, the right hand band mill set is zero inches, and the speed is 140 feet per minute. Diodes 322 are connected between input lead 27 and matrix output leads indicative of the desired sets. It will be noted that these sets, with reference to the chipper heads and band saws, are not the actual positions of such elements with respect to the sawmill center line, but are the sets relative to a zero set starting position. In the case of chipper heads, a zero set corresponds to a position of the chipper head one and seven-eighths inches from the sawmill center line, while a zero set for the band mills corresponds to band saw positions three and seven-eighths inches from the sawmill center line. It will be understood that corresponding combinations of diodes in the matrix are disposed between each of the forty-eight input leads 316 and ones of the thirty-four output leads 320 in accordance with the desired program stored by the memory matrix 318.

Memory matrix 318 may comprise one or a plurality of wired diode boards for providing the desired connections, and may be termed a read-only-memory. Alternatively, a commercially available read-only memory may be utilized wherein diode connections, transistor connections, or the like are provided therefor in an initial "programming" step, thereby enabling desired connections or alternatively disabling non-desired connections in accordance with a predetermined program. The program stored according to the present memory matrix is hereinafter more fully discussed.

The output leads 320 of memory matrix 318 are applied via driver means 324 to a coding matrix 326. The driver means 324 receives the six energized outputs from memory matrix 318 via ones of leads 320, according to the combination of sets prescribed, and applies corresponding drive on thirty-four corresponding leads 328 forming the input to the coding matrix. Thus, driver means 324 may comprise thirty-four relays wherein each of the leads 320 is connected to an operating coil for closing a contact delivering a voltage V to the coding matrix. Corresponding, in-line output leads are thereby energized.

The coding matrix converts the "sets" provided as outputs from matrix 318 to the actual setworks air cylinder combinations operated in order to secure those sets. Thus, the coding matrix drives thirty-one solenoids 328 for solenoid actuated valves, which in turn provide air pressure to correct ends of setworks cylinders associated with the backstands, left and right chipper heads, left and right movable band saws, and the speed control.

As indicated in the drawing, sixteen of the inputs to coding matrix 326 relate to separate backstand sets or positions, three are left chipper head sets or positions, five are right chipper head sets or positions, two are left movable band saw sets or positions, two are right movable band saw sets or positions, and six are carriage speeds. For convenience of explanation, the coding matrix 326 will be divided up into separate matrices associated with each one of the devices operated therefrom.

Figure 14:
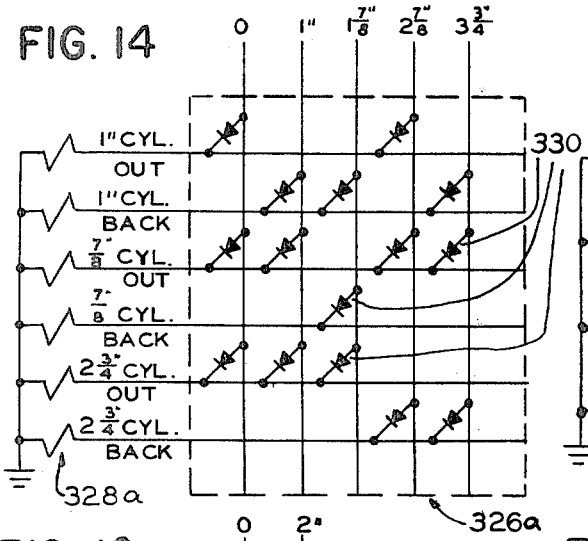

Referring to FIG. 14, illustrating a portion 326*a* of matrix 326 associated with the right chipper head positions, it will be seen that the input "set" leads (from matrix 318 via driver means 324) for right chipper head "sets" of zero, one inch, one and seven-eighths inches, two and seven-eighths inches, and three and three-fourth inches, are connected via diodes 330 for providing movements in the operation of the setwork cylinders positioned by means of valve solenoids 328*a*. These particular setworks cylinders are numbered 124 in the foregoing drawings. Respective valve solenoids 328*a* position the one inch cylinder respectively out and back, the seven-eighths inch cylinder respectively out and back, and the two and three-quarters inch cylinder respectively out and back. The actual air valve connection is not shown, being well understood by those skilled in the art.

Considering operation of FIG. 14 circuit, it will be seen that a "zero" set input will cause diodes connected to the zero set input lead to conduct for placing all three cylinders of setworks 124 in the "out" position, or that position which locates the chipper head nearest the center line of the sawmill. This position will be used as a basis and is one and seven-eighths inches from the center line of the mill. It will be further seen that if the one inch input is energized, diodes will be activated for operating the seven-eighths inch cylinder and the two and three-quarter inch cylinder in the out position, but the one inch cylinder will be operated in the "back" position thereby providing a one inch set relative to the "zero" set position. Furthermore, a one and seven-eighths inch input causes conduction in diodes connected to the one inch cylinder "back" solenoid, the seven-eighths inch cylinder "back" solenoid, and the two and three-quarters cylinder "out" solenoid, therefore resulting in a one and seven-eighths inch retraction from the "zero" position. The two and seven-eighths as well as the three and three-quarters inch inputs likewise energize the valve solenoids 328*a* in combination for providing the designated set.

Figure 15:
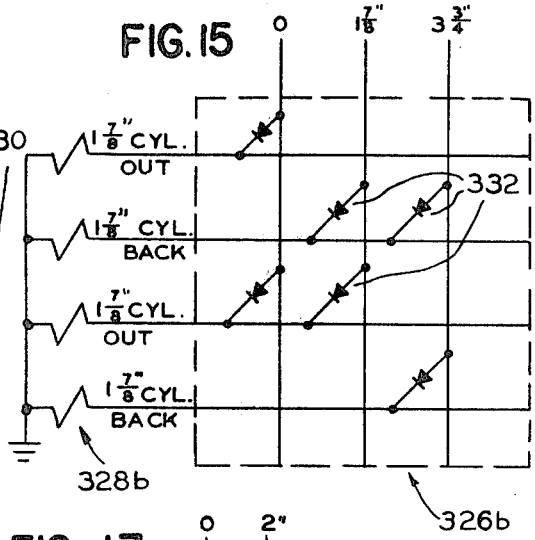

Referring now to FIG. 15, illustrating another portion of coding matrix 326, here designated 326*b*, it is seen that the three inputs are applied, via various diodes 332, to "out" and "back" valve solenoids for operating setworks cylinders 120 in the manner identified. The inputs supplied to the top of matrix portion 326*a* relate to the various "sets" to which it is desired to position the right chipper head. Each one of these leads is a different output of memory matrix 318 derived via driver means 324. The cylinders comprising setworks 120 are operated according to the activation of solenoids 328*b*. Each of the setworks cylinders has a stroke of one and seven-eighths inches, providing a total of three and three-quarters inches when both are in the "out" position. When the "zero" set input is applied, diodes energize both "out" valve solenoids causing both cylinders to assume their extended condition placing the left chipper head closest to the center line of the mill. This position is the basic portion, one and seven-eighths inches from the mill center line. When the one and seven-eighths set input is energized, the diodes connected thereto activate one of the cylinders solenoids to produce an "out" movement of one cylinder while the other cylinder is in a "back" position, thereby producing a one and seven-eighths set with respect to the zero basic location. When the three and three-quarters input is received, both setworks cylinders for setworks 120 are placed in a "back" position, withdrawing the left chipper head three and three-quarters inches from the zero set.

Figure 16:
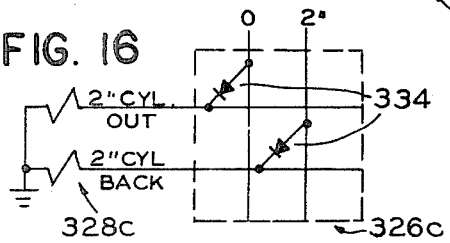

Referring to FIG. 16, the zero and two-inch set inputs derived from memory matrix 318 for the left movable band saw are applied to a portion of coding matrix 326 designated 326*c* comprising two diodes 334 which respectively energize a two-inch cylinder "out" valve solenoid and a two-inch cylinder "back" valve solenoid in the case of zero and a two-inch set input, respectively. The valve solenoids 328*c* are effective to cause operation of setworks cylinder 130 in the "out" and the "back" positions. It is seen this cylinder is extended for the zero set and retracted for the two-inch set.

Figure 17:
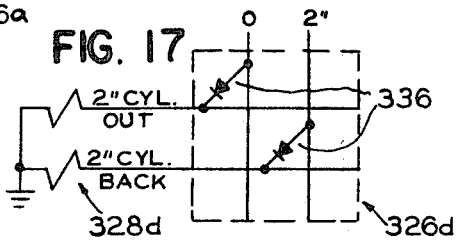

Substantially the same circuit configuration is employed in the case of the right movable band saw wherein valve solenoids 328*d* of FIG. 17 cause operation of setworks cylinder 132 in the "out" and "back" positions respectively. The FIG. 17 circuit includes matrix portions 326*d* incorporating diodes 336 connected as were diodes 334 in FIG. 16.

Figure 18:
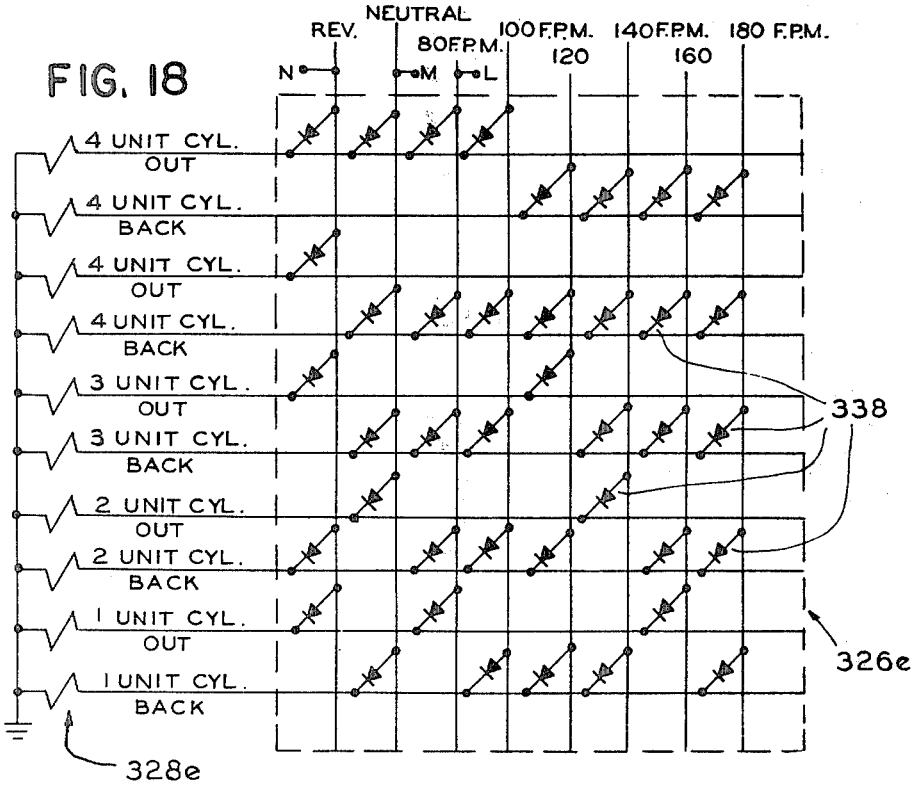

Referring to FIG. 18, a portion of matrix 326*e* is employed for energizing valve solenoids 328*e* utilized for positioning the individual cylinders of setworks 254 by valve action. Various of the diodes 338 connect the speed inputs derived from matrix 318 via driver means 324 to ones of the valve solenoids 328*e*. In the case of the 180 feet per minute input, each of the cylinders are in the "back" position or retracted. Thus, the handle 238 will be in the upraised position. For neutral position, on the other hand, the one unit, the three unit, and one of the four unit cylinders are in the "back" position while the two-inch cylinder and the remaining four unit cylinder are in the out position. It will be seen from examination of FIG. 18 that the successively reduced speed values therebetween will energize the solenoids 328*e* in combination for placing the lever 238 of FIG. 10 successively closer to the neutral location. In order to provide a reverse position, only the two unit cylinder is energized to its back location and the remaining cylinders are in their "out" location, this being the maximum extension for the setworks in this particular example. As hereinbefore explained, the various handle positions thereby achieved will predetermine the travel speed of the carriage in one of the forward positions for travel of the carriage to the right in FIG. 1, in neutral position, or in reverse for movement to the left in FIG. 1.

Figure 19:
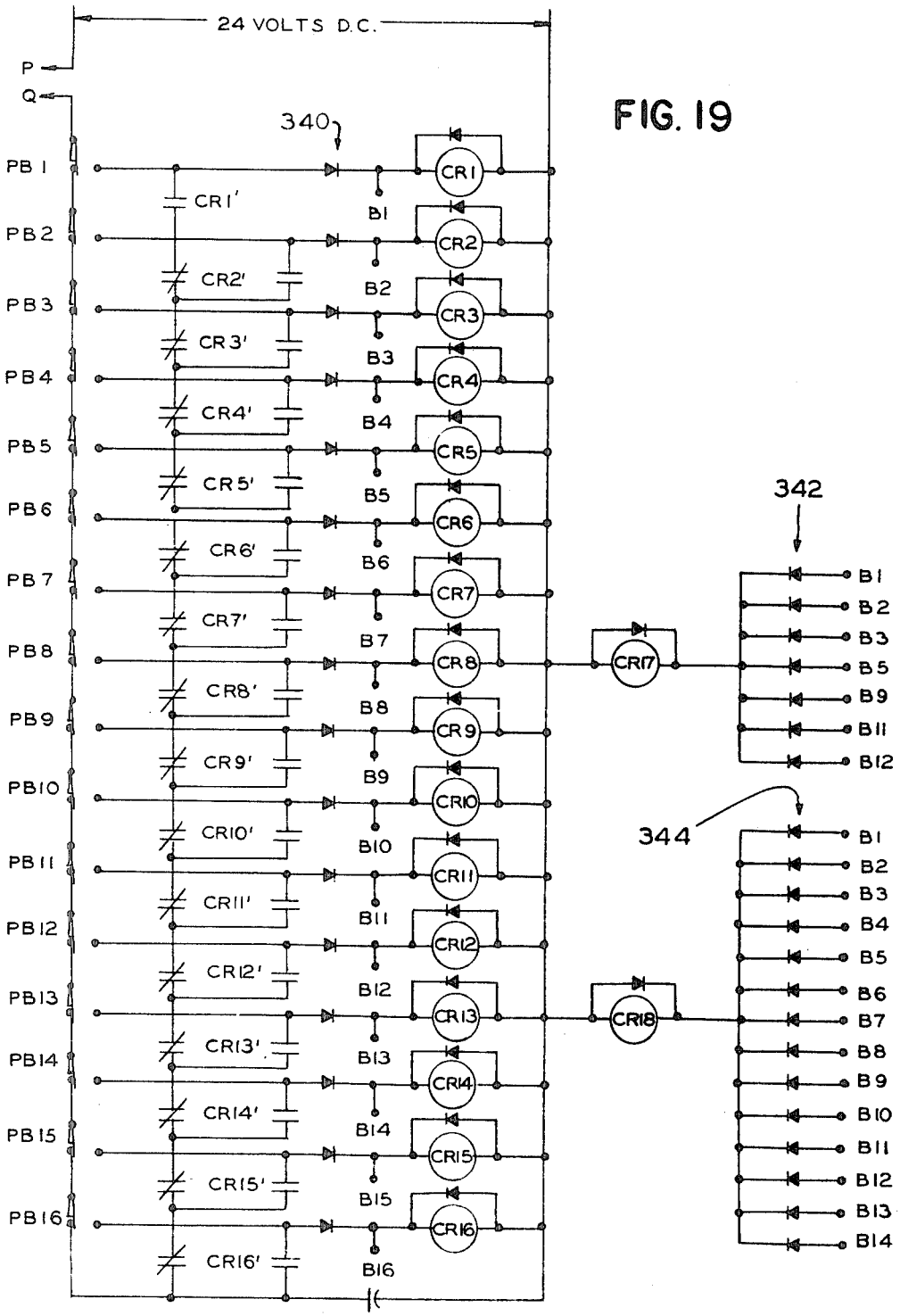

The coding matrix has been described thus far in diode matrix form, but it is realized the same coding can be implemented by relay circuitry, wherein a given input for a given "set" energizes a relay or relays having contacts connected for energizing the proper combination of setworks cylinders for bringing about that "set". Relay circuitry for operating the backstand setworks is illustrated in FIGS. 19 and 19A. The outputs derived from memory matrix 318 via driver means 324 are designated B1 through B16 and correspond to desired "sets" of $2\frac{1}{8}$ inches, $2\frac{1}{4}$ inches, $2\frac{3}{8}$ inches, $2\frac{1}{2}$ inches, $2\frac{5}{8}$ inches, $2\frac{3}{4}$ inches, $2\frac{7}{8}$ inches, 3 inches, $3\frac{1}{8}$ inches, 4 inches, $4\frac{1}{8}$ inches, $4\frac{1}{4}$ inches, $4\frac{3}{8}$ inches, $4\frac{1}{2}$ inches, $5\frac{7}{8}$ inches, and $7\frac{7}{8}$ inches. In this sequence, the smaller "sets" pertain to smaller logs, and the larger "sets" pertain to larger logs, the "sets" being measured from the mill center line. The circuitry of FIGS. 19 and 19A operates both the setworks 114 for backstand 106, and the setworks 116 for backstand 108. Referring particularly to FIG. 19A, the respective setworks cylinders heretofore referred to at 114 and 116 in FIG. 1 are positioned by means of valve solenoids AA, BB, CC, DD, EE, FF, and GG, which respectively cause extension to the outward position of each setworks one-eighth inch cylinder, one-fourth inch cylinder, one-half inch cylinder, one inch cylinder, a first two inch cylinder, a second two inch cylinder, and a four inch cylinder. The solenoid operated valves only in the case of the backstand setworks are suitably spring reversed such that in the absence of energization of a respective solenoid AA through GG, the corresponding cylinder will return to a retracted or "back" position. Thus no "back" solenoid valves need be employed in the case of the backstand setworks.

The relay circuitry of FIGS. 19 and 19A is arranged so that it is alternatively operable by means of push buttons PB1 through PB16, or automatically from the memory matrix via leads B1 through B16. Thus, to produce a backstand "set" for each of the backstands 106 and 108 of $2\frac{1}{8}$ inches, push button PB1 may be depressed. Each of the push buttons comprises a spring loaded single pole, double throw switch, where the movable contact normally makes connection with the left hand fixed contact as illustrated.

Let us assume, for example, that push button PB15 is depressed. A circuit is completed through the normally closed contacts of push buttons PB1 through PB14 and terminals P, Q (connected by normally closed contacts not shown in this figure) to a 24 volt d.c. source, which PB15 then connects through a diode 340 to operating coil CR15. Relay coil CR15 closes contacts CR15*a*, CR15*b* and CR15*c* in FIG. 19A. Consequently, the solenoids AA, FF and GG will be connected to the 115 volt a.c. source, actuating the same to the "out" position for controlling setworks 114 and 116. The total "set" will consequently be the sum of $\frac{1}{8}$ inch, two inches, and four inches, providing a total of $6\frac{1}{8}$ inches.

Depression of push button PB15 is arranged to produce a "set" of $5\frac{7}{8}$ inches from the sawmill center line. However, the condition of the setworks 114 and 116 with all cylinders retracted corresponds to a "set" of twelve inches and, consequently, to produce a $5\frac{7}{8}$ inch set, setworks cylinders must be energized providing a total stroke of $6\frac{1}{8}$ inches, or twelve minus $5\frac{7}{8}$.

In addition to contacs CR15*a*, CR15*b*, and CR15*c*, operating coil CR15 also opens normally closed and closes normally open contacts CR15'. Consequently, a holding circuit can be completed through the normally open contact CR15', normally closed contact CR16', and the left hand contacts of the push buttons. The actuation of the normally closed contacts CR15' disables any operating coils theretofore operated above operating coil CR15, while initial operation of push button PB15 opens the circuits to the operating coil therebelow. The arrangement is such that depression of a push button associated with the particular operating coil results in the de-energization of the other push button operated coils whereby only one "set" may be selected by the push buttons at a time.

As hereinbefore mentioned, the inputs B1 through B16 are derived from the first sixteen outputs of memory matrix 318. Only one such output is active at a time, as hereinbefore described, and the connection P, Q is broken in between such outputs. It is noted that the inputs B1 through B16 are applied not only to the operating coils CR1 through CR16, respectively, but also selected of these inputs are applied to operating coil CR17 through diodes 342 as well as operating coil CR18 through diodes 344. Thus, an "or-gate" is formed by diodes 342 and a second "or-gate" is formed by diodes 344 whereby operating coils CR17 and CR18 are energized if one of the respective inputs of a group is present. Combining inputs in this way simplifies the circuitry, or the number of different relays requiring multiple contacts. Thus, in the case when an input B1 is applied, both operating coils CR17 and CR18 are energized. Consequently, solenoids AA, BB, and CC are provided current from the 115 volt a.c. source through relay contacts CR17*a*, CR17*b* and CR17*c*. Likewise, the solenoids DD, EE, FF, and GG are provided current via contacts CR18*a*, CR18*b*, CR18*c*, and CR18*d* operated by the coil CR18. Consequently, all of the solenoids are operated for placing all of the backstand setworks cylinders in their extended position bringing about a total cylinder stroke of 9⅞ inches to provide a "set" of 2⅛ inches from the mill center line. It will be noted that operating coils CR17 and CR18 are similarly actuated via the "B" connections in the instance of push button operation.

Also, certain relays are provided with normally closed contacts operative in certain instances to bring about the correct combination of setworks cylinder actuation. Thus, solenoid AA has in series therewith a normally closed contact CR2*a* which opens in the case when operating coil CR2 is energized for a 2¼ inch set. Consequently, the ⅛ inch cylinder remains in its retracted position for this set, while the remaining cylinders, BB through GG, are actuated. Further operation of the circuitry of FIGS. 19 and 19A implements the following table of sets. Sets and total cylinder strokes are given in inches.

Table I

| SET | CYLINDER STROKE | ⅛" | ¼" | ½" | 1" | 2" | 2" | 4" |
|---|---|---|---|---|---|---|---|---|
| | | AA | BB | CC | DD | EE | FF | GG |
| 2⅛ | 9⅞ | AA | BB | CC | DD | EE | FF | GG |
| 2¼ | 9¾ | | BB | CC | DD | EE | FF | GG |
| 2⅜ | 9⅝ | AA | | CC | DD | EE | FF | GG |
| 2½ | 9½ | | | CC | DD | EE | FF | GG |
| 2⅝ | 9⅜ | AA | BB | | DD | EE | FF | GG |
| 2¾ | 9¼ | | BB | | DD | EE | FF | GG |
| 2⅞ | 9⅛ | AA | | | DD | EE | FF | GG |
| 3 | 9 | | | | DD | EE | FF | GG |
| 3⅛ | 8⅞ | AA | BB | CC | | EE | FF | GG |
| 4 | 8 | | | | | EE | FF | GG |
| 4⅛ | 7⅞ | AA | BB | CC | DD | | FF | GG |
| 4¼ | 7¾ | | BB | CC | DD | | FF | GG |

Table I-continued

| SET | CYLINDER STROKE | ⅛" | ¼" | ½" | 1" | 2" | 2" | 4" |
|---|---|---|---|---|---|---|---|---|
| 4⅜ | 7⅝ | AA | | CC | DD | | FF | GG |
| 4½ | 7½ | | | CC | DD | | FF | GG |
| 5⅞ | 6⅛ | AA | | | | | FF | GG |
| 7⅞ | 4⅛ | AA | | | | | | GG |

Now considering overall operation of the automatic sawmill according to the present invention, powered feedrolls 36 are first lowered placing one or more logs on chains 40 which are driven by motor 142 against pin stops 42. The pin stops are momentarily lowered and the chains advanced for placing one log across cradles 58 and 59, between such cradles and the forward portions 150 of the charger beams. With the charger beams fully retracted, the log will be centered beneath caliper device 24. Caliper device 24 is lowered by a remote push button at which time arms 70 and 72 thereof are fully apart. The caliper frame 64 lowers only to a point whereby the arms 70 and 72 may be moved toward one another for measuring the log, and not to a point at which any other part of the caliper device will touch the log. Thus, the throw of cylinder 62 is short enough to prevent such further contact. Now, a remote control push button is operated for causing the charger arms 70 and 72 to move toward one another. Air motor 66 is operated and for every one-fourth inch of total caliper movement, an additional count is applied to the couting means in the data processing circuitry, starting when the caliper arms are sixteen inches apart. When the caliper arms contact the log, the counting output naturally stops, and the count is held in the data processing circuitry as a memory address. At this time, the caliper device may be raised by remote control, and when the caliper frame is fully up, limit switch LS2 is actuated. Also, the caliper arms are opened either automatically or by a remote control push button.

With the caliper raised, and the carriage 26 at its extreme left hand position, the data processing circuitry is instructed to address the memory matrix 318 for providing "set" outputs for the backstand positions, left and right chipper heads, left and right movable band saws, and carriage speed. Also when the caliper is raised and limit switch LS2 is operated, the charger beams start forward under the control of hydraulic cylinders 56 and 57. This assumes that the carriage is at the extreme left hand position as indicated by operation of limit switch LS1. When the log carried by the charger arms reaches the backstands 106 and 108, the supply of hydraulic fluid to the charger operating cylinders 56 and 57 is turned off whereby the log will remain in a position with its forward side at the locations of the backstand fingers, i.e. in parallel relation to the center line of the sawmill carriage. When the backstand fingers are contacted, they also automatically retract. The backstands are retracted by breaking contact between terminals P and Q in FIG. 19 causing each of the backstands setworks cylinders to assume their retracted position. As the backstand fingers retract, they bring about operation of air cylinder 104 for dogging the log between toothed dogs 100 and 101.

As the log is dogged, the air pressure in the supply line to cylinder 104 is detected and the charger cradles move downwardly under the control of air cylinders 60 until limit switch LS5 is operated. And at this time the charger beams retract. Limit switches LS6 and LS7 detect the fact that the charger means is in its retracted position, and in conjunction with the pressure switch indicating the dogging of the log, carriage travel to the left will be started automatically. As the carriage starts to move forward, a limit switch, LS3, resets the data processing circuitry at terminal Z so that another log can then be calipered while the first log is being cut.

Figure 10:
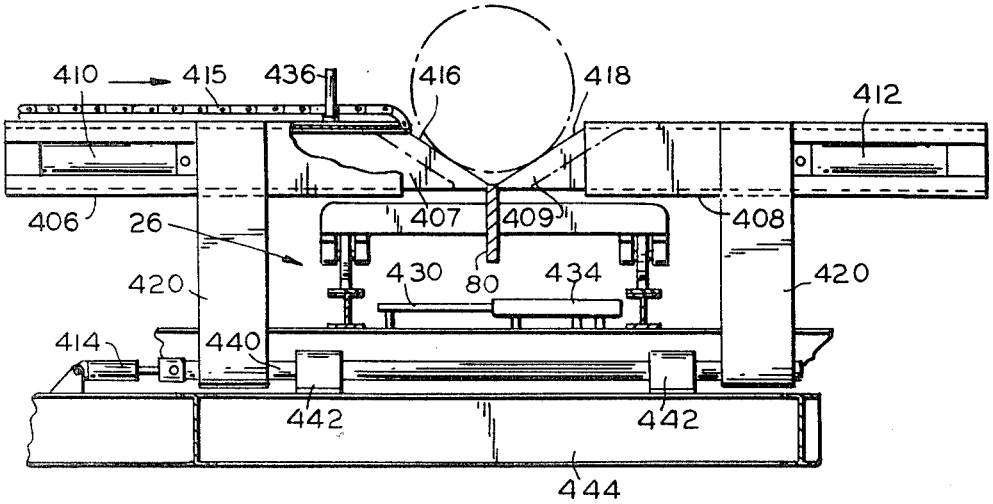
Figure 10:
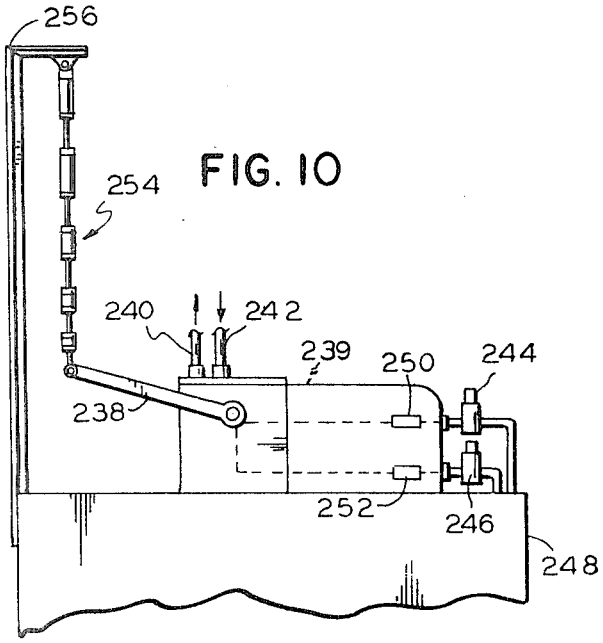

A limit switch adjacent the carriage, at sixteen inches to eighteen inches before the end of travel, namely, limit switch LS8, deactivates the air cylinder 104 on the carriage for undogging the center cant remaining after the log is cut, the side boards or slabs therefrom having fallen on the outfeed rolls 222. Other limit switches, LS8 and LS10, function to slow down and stop the forward movement of the carriage and the position of the speed control lever 238 in FIG. 10 is reversed. End of travel limit switch LS10 also operates sweep arm 136 to insure removal of the center cant from the carriage. When the sweep arm completes its cycle back and fourth, its return to normal position is detected and the carriage is started back towards its left hand position. Complete return of the carriage is detected by limit switch LS1 and another cycle of operation is enabled, i.e. the forward movement of the charger beams can again take place.

Figure 12A:
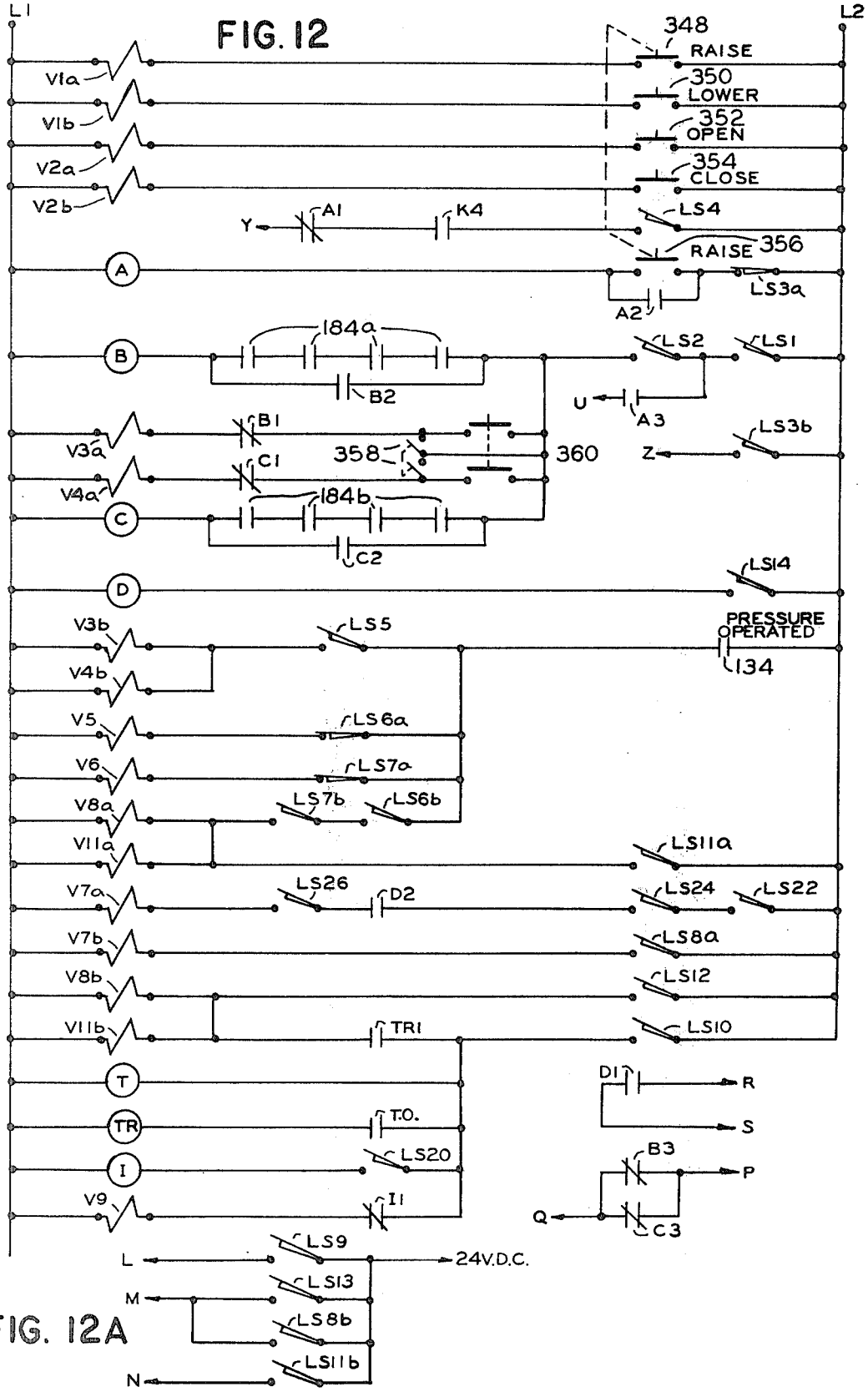

More detailed consideration of the system operation together with the control and limit switch circuits for bringing about the operating sequence, will be considered with the aid of FIG. 12 which comprises a schematic diagram of the system control. Referring to FIG. 12, push buttons 348, 350, 352, and 354 are located on an operator's console, (not shown) preferably positioned toward the left hand end of the mill. These push buttons control operation of the valves which operate air cylinder 62 and air motor 66 on the caliper device 24. Valve solenoids V1*a* and V1*b* bring about the raising and lowering of the caliper frame by extension and retraction of the operating rod 276 of cylinder 62. The details of valve construction are not shown since the same are readily understood by those skilled in the art. Also, valve solenoids V2*a* and V2*b* operate air motor 66, respectively, in the caliper open and caliper close directions. Valve solenoid V1*a* is connected in series with push button 348 between lines L1 and L2 (connected to 115 volts a.c.). Similarly push buttons 350, 352, and 354 are connected respectively in series with valve solenoids V1*b*, V2*a* and V2*b* across the lines L1 and L2.

Assuming the caliper device 24 is in an upraised position, the operator depresses push button 350 for actuating valve solenoid V1*b* and lowering the caliper device in position for measuring a log. Then, push button 354 is depressed whereby valve solenoid V2*b* operates air motor 66, closing the caliper arms on the log. When the caliper arms 70 and 72 are slightly more than sixteen inches apart, limit switch LS4 operates closing a circuit from line L2 to contacts K4 of switch 284. Thereafter, successive closure of the switch, as threaded rod 74 rotates, provides an impulse output at Y through normally closed contacts A1. This input is applied to the counter means in FIG. 13 as hereinbefore described. The calipers are subsequently raised by operation of push button 348 in ganged relation with push button 356 whereby operating coil A is energized, opening contacts A1 and closing contacts A2 and A3. Contacts A2 maintain the circuits for coil A around the push button 356 so long as normally closed limit switch contacts LS3*a* are not open. These contacts open when the carriage moves forwardly to the right, limit switch LS3 being located just to the right of fully retracted position of carriage head 82 as seen in FIG. 1. Contacts A3 close and provide a voltage terminal U for gating the count in counter means 292 through and-gates 309 in FIG. 13 and thereby addressing the memory matrix 318 for accessing stored "set" values therefrom. It is noted that limit switch LS1 is closed with the carriage in a fully left hand or retracted position.

It will be recalled that a further cylinder 272 can be employed for telescoping the caliper device frame. This can be employed for avoiding a protrusion or knot. The circuit for operating the same (not shown) can be substantially similar to the circuitry disclosed for raising and lowering or opening and closing the calipers.

When the caliper device is raised, limit switch contacts LS2 close providing a circuit for the series combination of backstand switch contacts 184*a* and operating coil B. Also, assuming ganged switches 358 are closed, operating power is provided through normally closed contacts B1 to valve solenoids V3*a* and through normally closed contacts C1 to valve solenoid V4*a*, as well as to the serial combination of backstand switch contacts 184*b* and operating coil C. The switch contacts 184*a* and 184*b* are associated respectively with the respective fingers 110 of the left hand backstand 106 and the four fingers 111 of the right hand backstand 108. Thus, when all of the fingers 110 are contacted by a log, all of the contacts 184*a* close. When all of the fingers 111 are contacted by a log, the switch contacts 184*b* will all close. The contacts B2 associated with operating coil B and contacts C2 associated with operating coil C shunt the series arrangement of contacts 184*a* and 184*b* respectively. Valve solenoids V3*a* and V3*b*, respectively, bring about forward and rearward movement of the charger beam 44 through control of hydraulic cylinder 56, while valve solenoids V4*a* and V4*b* respectively cause movement of the charger beam 45 toward and away from the sawmill carriage through control of hydraulic cylinder 57. Ganged push buttons 360 may be employed for moving the charger forwardly towards the carriage under the operator's control, at which time ganged switches 358 are opened. However, assuming ganged switches 358 are closed, the aforementioned operation of limit switches LS1 and LS2 moves both charger beams forwardly toward the carriage, through energization of valve solenoids V3*a* and V4*a*, carrying a log therewith.

When the log contacts the fingers 110 of left hand backstand 106, the contacts 184*a* will close (one being operated by each finger) and operating coil B will be energized. Consequently, normally closed contacts B1 will open, de-energizing valve solenoid V3*a*. The valve operated by solenoids V3*a* and V3*b* as well as the valve operated by solenoids V4*a* and V4*b* are of the type which returns to neutral or shuts off if one of the solenoids is not energized. Consequently, opening of contact B1 shuts off the flow of hydraulic fluid to hydraulic cylinder 56. Similarly, when the log contacts the backstand fingers 111, the contacts 184*b* will close, energizing coil C and opening normally closed contacts C1, whereby solenoid V4*a* is de-energized for discontinuing the flow of hydraulic fluid to cylinder 57. At this time the log will be located with its forward side parallel to the center line of the mill. It is noted holding circuits are provided around contacts 184*a* and 184*b* by contacts B2 and C2 respectively.

Assuming the carriage is retracted or in its left hand position, limit switch LS14 is closed and therefore coil D is energized for closing contacts D1 and D2. Contacts D1 are in series with the control power to the left and right chipper head and left and right movable band saw setworks within driver means 324 via terminals R and S. Therefore, the chipper heads and movable band mills may be set at this time but not when the carriage is moving to the right. Also, terminal D2 closes in a series circuit with limit switches LS22, LS24, and LS26 and with dog operating solenoid V7*a*. Limit switch LS26 is operated when the charger beams are in toward the carriage and limit switches LS22 and LS24 are closed when the backstands retract. The backstands retract when coils B and C operate, opening the normally closed contacts B3 and C3, breaking the connection between the terminals P and Q connected in series with the 24 volt supply in FIG. 19. As hereinbefore mentioned, the setworks for the backstands are valved for returning to the retracted position when the valve solenoids AA through GG in FIG. 19A are de-energized. It is seen a circuit is provided for valve solenoid V7*a* in FIG. 12, which operates air cylinder 104 moving dog 100 to the right. When the log is fully dogged, air pressure in the line to cylinder 104 operates contacts 134. Solenoids V5 and V6 are thereby energized through normally closed contacts of limit switches LS6*a* and LS7*a* wherein valve solenoids V5 and V6 bring about operation of cylinders 60, extending the operating rods thereof, and lowering the cradles 58 and 59. When the cradles are down, in such a position that the charger beams may be retracted, limit switch LS5 is operated which closes a circuit to valve solenoids V3*b* and V4*b* associated with the hydraulic cylinders 56 and 57. Solenoids V3*b* and V4*b* cause the hydraulic cylinders 56 and 57 to move the charger beams 44 and 45 back to their original position, i.e. with the cradles 58 and 59 disposed under caliper device 24. When the charger beams thus return to their retracted position, normally closed limit switch contacts LS6*a* and LS7*a* open, and normally open limit switch contacts LS6*b* and LS7*b* close, whereby valve solenoids V5 and V6 are de-energized while valve solenoids V8*a* and V11*a* are energized. The de-energization of solenoids V5 and V6 brings about reverse operation of air cylinders 60 such that the cradles 58 and 59 are moved back to their upraised location. Energization of valve solenoids V8*a* and V11*a* closes valves 244 and 246 in FIG. 10 so that oil pressure builds up in the control cylinders 250 and 252 of pump 239. Under these conditions, the carriage is ready for travel to the right at a speed determined by setworks 254 in FIG. 10, the setworks having been positioned through operation of the memory matrix 318 at the delivery of a signal at terminal U. The carriage therefore moves to the right.

As the carriage travels to the right, limit switch LS3 is operated, opening contacts LS3*a* and closing contacts LS3*b*. The circuit to coil A is thereby broken, and also a reset signal is provided at terminal Z for the counter means of FIG. 13. With the log moving through the chipper heads and band mills, the same is cut into the desired thicknesses, and as the carriage proceeds to near the end of its travel, limit switch LS9 is operated (see FIG. 12A) providing operating voltage at terminal L in FIG. 18 for slowing down the carriage to 80 feet per second from the speed theretofore programed, assuming the same was not already 80 feet per second. If, of course, the speed was already set at 80 feet per second, the voltage L will produce no change in the setworks 254. As the carriage proceeds farther, limit switch contacts LS8*a* of limit switch LS8 are operated which energizes valve solenoid V7*b* for operating cylinder 104 to the left, undogging the center cant remaining after the log has been sawed. This allows full release of the center cant before the carriage reaches the right hand extremity of travel. Also, limit switch contacts LS8*b* provide 24 volts to terminal M controlling the setworks 254 for the speed control handle 238 in FIG. 10, placing the same in the neutral position by means of applying such voltage to the neutral input of the coding matrix portion 326*e* in FIG. 18.

At the end of the carriage travel, limit switch LS10 is actuated for energizing operating coil T. Operating coil T has time operated contacts T.O. which close immediately, but which open after approximately one-half second. These contacts T.O. energize timed relay operating coil TR which closes normally open contacts TR1 and holds the same closed for a predetermined period of time, operating solenoids V8*b* and V11*b* for allowing the hydraulic fluid to drain from control cylinders 250 and 252 in pump 239 inasmuch as valve solenoids V8*b* and V11*b* open valves 244 and 246 for such time. Thus valves 244 and 246 remain open for at least such time.

Also, when limit switch LS10 is operated, valve solenoid V9 is energized through normally closed contacts I1, valve solenoid V9 controlling cylinder 234 which moves the sweep arm 136 in a direction for removing the center cant from the carriage. When the sweep arm moves in a clockwise direction, as viewed from the output end of the mill, limit switch LS20 is operated energizing coil I, opening contacts I1, and de-energizing valve solenoid V9. The sweep arm then automatically returns to its counterclockwise position, out of the way of carriage movement, and operates limit switch LS11 (only as the arm returns). Limit switch contacts LS11*a* re-energize valve solenoids V8*a* and V11*a* returning hydraulic fluid to the control cylinders 250 and 252 in FIG. 10. Contacts LS11*b* (see FIG. 12A) energize terminal N connected as shown in FIG. 8 to bring about a desired reverse speed. This reverse speed may be adjusted by various combinations of setworks cylinder valve solenoids to provide a higher or lower reverse speed according to the positioning of control handle 238 produced thereby. In general, fairly high reverse speed is suitabele, e.g. reverse speeds of 180 feet per minute and greater up to approximately 300 feet per minute. Since the carriage speed control is in reverse, the carriage now returns, and near the left hand end of its travel operates limit switch LS 13 (see FIG. 12A for electrical connection) energizing terminal M and throwing the control handle 238 in FIG. 10 into neutral. The carriage then contacts limit switch LS12 which operates valve solenoid V8*b* and V11*b* for draining the hydraulic fluid from control cylinders 250 and 252 via valves 244 and 246 in FIG. 10. The carriage then operates limit switches LS14 and LS1, completing the cycle of sequence control.

The automatic sawmill according to the present invention receives and cuts logs in rapid sequence, and in a manner for obtaining the maximum size and number of board feet for each log. For the purpose of obtaining the optimum lumber output from each log a "program" is stored in the memory matrix 318 and FIG. 13 which is adapted to position the backstands, movable chipper heads, and movable band saws to provide this optimum output. In the sawmill according to the described embodiment of the present invention, the carriage remains stationary on mill center line so far as the transverse axis is concerned (the transverse axis being a line perpendicular to carriage beam 80). Therefore, the band mills 30 and 32 can remain stationary for cutting a central cant, with one of the two band saws disposed on each side of the carriage beam 80. Then, the log is initially moved in the transverse direction by the charger means for selecting the part of the log cross section from which this center cant will be taken. It is generally desirable that the center cant be more or less central in the log, i.e. proximate the maximum vertical diameter of the log as it resides on the carriage. However, it should be clear that the center cant will not be taken along the exact center line of the log. Thus, the usual Douglas fir log, for example, has a taper of about one inch in ten feet depending upon altitude. The above approximation is characteristic of stands near sea level while the taper increases at higher altitudes. According to one important feature of the present apparatus, the backstand method of cutting is employed wherein the forward side of the delivered log (as presented to the backstands) is parallel to the carriage center line, rather than the center line of the log being parallel to or coincident with the carriage center line. Consequently, the center cant will be cut at an angle to the log center line. Moreover, it has been found desirable in the programing, to optimize the lumber output of a log, that the center cant sometimes be slightly off center with respect to the calipered measurement. However, the programing in general accomplishes cutting of the center cant as near the center as possible, i.e. near the maximum vertical diameter of the log, as is consistent with providing additional boards from the log, so as to avoid the remanufacture necessitated by a center cant with unduly tapered side edges. The program balances the gain to be obtained in providing an additional two-by-four member or the like with the edge loss which may be occasioned when the center cant is slightly off center, and provides cutting instructions which will supply an optimum output.

The backstand method of cutting, wherein the forward side of the log is parallel to the mill center line rather than having the log center line parallel to the mill center line, is desirable in the automated sawmill in that a greater output can be secured in this manner for incremental increases in log diameter. Thus, if the log diameter increases by approximately 1¾ inches, an additional two-by-four may be obtained from the log, not obtainable in the case of center line cutting. In the instance of center line cutting, the incremental increase as mentioned would appear half on each side of the log center line, and additional two-by-fours would not be secured until the log diameter increased by at least another 1¾ inches. No matter what the nominal increase in log diameter may be, the backstand method of cutting usually provides larger outputs inasmuch as incremental increases can be utilized to the maximum and are not divided half on each side of the log.

It is realized, of course, that larger pieces are more desirable, and, in part, the optimized performance of the present apparatus relates to securing of the maximum number of board thicknesses which are at least two inches in nominal thickness. One purpose of the present apparatus is the production of two-by-four studs for housing and the like.

The program is predetermined to provide first, the desired center cant (placed as near center as feasible, particularly in the case of smaller diameter logs); second, as many nominal two-inch thicknesses which will not subtract unduly from center cant positioning; and third, the maximum number of nominal one-inch thicknesses, on the same criteria basis, when two-inch thicknesses are not possible or an additional two-inch increment is not contained within the log diameter.

It will be appreciated that there are width requirements as well as thickness requirements to a two-by-four piece, for example. Thus, the log diameter must increase enough so that enough additional material is present to provide the required width within the side curvature of the log, although some bevel is permissible. The round at the outside transverse edge extremity is, of course, removed by one of the chipper heads. In some instances, a board of at least partial length may be obtained at the tapered side of the log. Therefore, in general, smaller pieces are programed for cutting from this side of the log, i.e. the side farthest from the backstands. The resultant slab on this may or may not be suitable for actual use, depending upon the actual shape and taper of the particular log.

The programing of the apparatus in the instance of the particular mill hereinbefore described is summarized in the following table:

Table II

| LOG | BACK STAND | LC SETS | RC SETS | LBM SETS | RBM SETS | SPEED | OUT |
|---|---|---|---|---|---|---|---|
| 4.25 in | 2.125 | 0 | 0 | 0 | 0 | 180 | 4 |
| 4.5 | 2.25 | 0 | 0 | 0 | 0 | 180 | 4 |
| 4.75 | 2.375 | 0 | 0 | 0 | 0 | 180 | 4 |
| 5.0 | 2.5 | 0 | 0 | 0 | 0 | 180 | 4 |
| 5.25 | 2.625 | 0 | 0 | 0 | 0 | 180 | 4 |
| 5.5 | 2.75 | 0 | 1.0 | 0 | 0 | 180 | 4,1 |
| 5.75 | 2.875 | 0 | 1.0 | 0 | 0 | 180 | 4,1 |
| 6.0 | 3.0 | 0 | 1.0 | 0 | 0 | 180 | 4,1 |
| 6.25 | 3.125 | 0 | 1.0 | 0 | 0 | 160 | 4,1 |
| 6.5 to 7 | 4.125 | 1.875 | 0 | 0 | 0 | 160 | 2,4 |
| 7.25 to 7.75 | 4.125 | 1.875 | 1.0 | 0 | 0 | 160 | 2,4,1 |
| 8.0 to 8.25 | 4.125 | 1.875 | 1.875 | 0 | 0 | 160 | 2,4,2 |
| 8.5 | 4.25 | 1.875 | 1.875 | 0 | 0 | 160 | 2,4,2 |
| 8.75 | 4.375 | 1.875 | 1.875 | 0 | 0 | 140 | 2,4,2 |
| 9.0 | 4.5 | 1.875 | 1.875 | 0 | 0 | 140 | 2,4,2 |
| 9.25 to 9.5 | 4.0 | 1.875 | 2.875 | 0 | 0 | 140 | 2,4,2,1 |
| 9.75 | 4.0 | 1.875 | 3.75 | 0 | 0 | 140 | 2,4,2,2 |
| 10.0 to 10.5 | 5.875 | 3.75 | 1.875 | 0 | 0 | 140 | 2,2,4,2 |
| 10.75 | 5.875 | 3.75 | 2.875 | 0 | 0 | 140 | 2,2,4,2,1 |
| 11.0 to 11.25 | 5.875 | 3.75 | 2.875 | 0 | 0 | 120 | 2,2,4,2,1 |
| 11.5 to 12.5 | 5.875 | 3.75 | 3.75 | 0 | 0 | 120 | 2,2,4,2,2 |
| 12.75 to 13.0 | 5.875 | 3.75 | 2.875 | 0 | 2.0 | 120 | 2,2,4,4,1 |
| 13.25 | 5.875 | 3.75 | 2.875 | 0 | 2.0 | 100 | 2,2,4,4,1 |

Table II-continued

| LOG | BACK STAND | LC SETS | RC SETS | LBM SETS | RBM SETS | SPEED | OUT |
|---|---|---|---|---|---|---|---|
| 13.5 to 14.5 | 5.875 | 3.75 | 3.75 | 0 | 2.0 | 100 | 2,2,4,4,2 |
| 14.75 | 7.875 | 3.75 | 2.875 | 2.0 | 2.0 | 100 | 2,4,4,4,1 |
| 15.0 to 15.25 | 7.875 | 3.75 | 2.875 | 2.0 | 2.0 | 80 | 2,4,4,4,1 |
| 15.5 to 16 | 7.875 | 3.75 | 3.75 | 2.0 | 2.0 | 80 | 2,4,4,4,2 |

Table II indicates the sets for each of the log diameters in the left hand column. The sets are indicated in inches, with LC and RC referring to the left chipper head and right chipper head respectively, while LBM and RBM stand for the left movable band mill and right movable band mill. The speed is indicated in feet per minute, and the last or "OUT" column indicates the thicknesses cut for the particular log diameter. Thus, the top four log measurements each provide a nominal four-inch center cant, while the 5.75, 6.0 and 6.25 inch diameters provide a four-inch center cant as well as at least a possibility of a one-inch board thickness at the side of the log opposite the backstands. The log diameters 6.5, 6.75 and 7 inches are cut into a two-inch thickness on the backstand side as well as a four-inch center cant. It is seen that the backstand is moved to position or locate the four-inch center cant on the log. The band mills 30 and 32 which saw the center cant are thus stationary in the present embodiment. The movable chipper heads and band mills are located relative to the fixed band mills for sawing the additional boards. The sets reach their maximum values for the 15.5, 15.75 and 16 inch diameter logs, from which three four-inch thicknesses and two two-inch thicknesses (nominal) are obtained.

It will be appreciated that the Table II program is implemented in the hereinbefore described manner. The various log diameters result in the inversely related number of impulses at terminal Y in FIG. 13 circuit, starting with one impulse for the 16 inch log, increasing one impulse for each quarter-inch increment down to 48 impulses for the 4.25 inch log. The various sets are implemented in memory matrix 318 employing a plurality of diodes for each log-diameter-indicating input lead 316. The diodes driven by an input lead are connected to output leads 320 corresponding to given "sets" of the backstands, chipper heads, movable band mills and speed controlling devices. Thus, the input (27) for memory matrix 318 indicative of 27 input impulses corresponds to the sixteenth line of the table and specifically to a log having a measured diameter of 9½ inches. The resultant output comprises a nominal four-inch center cant, two two-inch thicknesses and one one-inch thickness.

The numbers found in Table II correspond to board thicknesses derived according to given thickness standards taking saw kerfs into consideration and it will be appreciated the exact numbers employed are by way of example. The speeds indicated are those found most suitable for cutting the various diameter logs in the particular mill herein disclosed, and naturally the speed values decrease with increasing log size and number of cuts provided. It will also be noted that the actual chipper head positions result from a combination of the band mill sets and the chipper head sets, inasmuch as the chipper heads are mounted on the movable band mill husks.

FIGS. 20A, 20B and 20C illustrate cutting cross sectional diagrams for logs having diameters of 5½ inches, 9½ inches and 13¼ inches, by way of example. These cross sections view the log from the head end of the mill and in each case the center line on the drawing represents the mill center line, with the portion of the log intersected thereby comprising the "center cant". The portions having section shade lines indicate those portions removed by the chipper heads, and solid lines indicate saw mill cuts, while the dashed lines indicate further cuts which may be made by subsequent conventional sawing equipment for cutting the cants and slabs produced into a plurality of two-by-fours, one-by-fours and one-by-twos. Obviously, four-by-fours may in some instances be provided where a pair of two-by-fours are here indicated in side by side relation on the diagrams.

In FIG. 20A, illustrating cuts for a 5½ inch diameter log, the four-inch thickness center cant is nearly all that can be provided from this log in a profitable manner, i.e. for producing a four-by-four or a pair of two-by-fours. The center cant is substantially centered at the small log end to make sure this much is obtained from the log. However, since the small end of the log is measured and herein represented, there is some possibility that at least part of another board may be procured from the right side of the log as the log tapers, and consequently the chipper head is pulled back an inch farther on the right than on the left. Off centering the center cant in this instance would lessen the possibility of the larger more profitable pieces being cut from the log.

In FIG. 20B the center cant is off center slightly, and beginning with the backstand position on the left, a two-inch thickness is provided followed by a four-inch thickness (center cant), another two-inch thickness, and a one-inch thickness. The possible boards which may be derived therefrom are indicated by dashed lines. In FIG. 20C, the combination of a pair of two-inch thicknesses, a pair of four-inch thicknesses, and a one-inch thickness is illustrated. In this instance, the center of the log is again slightly displaced from the mill center line in order to make the best use of the log content. The cutting program for each of the other diameters is clearly set forth in Table II.

Figure 11:
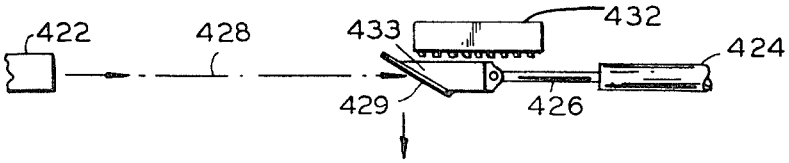

Referring to FIG. 11, an alternative embodiment of a charger and calipering mechanism according to the present invention is illustrated. Approximately the same carriage mechanism can be employed and is referred to by the same reference numerals as used heretofore. In the present instance, charger beams 407 and 409 are slideable horizontally within charger support structures 406 and 408. Thus, the first charger beam 407 is slideable horizontally within the support structure by means of hydraulic cylinder 410 while the second charger beam 409 is slideable horizontally under the control of hydraulic cylinder 412. In the normal or log receiving position, charger beams 407 and 409 are disposed in relatively close proximity to each other and to carriage beam 80 as illustrated in full line on the drawing. A chain conveyor 415 is adapted to transport a log against pin stops 436, and when such pin stops are lowered, the log may be transported to the angular forward portion 416 of charger beam 407 whereby the log is delivered to the central position between the angular forward portion 416 of beam 407 and angular forward portion 418 of beam 409. It will be appreciated that the charger structure is duplicated at a second location along the carriage, as in the previously described embodiment, to provide independently operated carriage means for "backstanding" the log properly.

When a log resides between angular forward portions 416 and 418, the diameter thereof is calipered by optical and electronic means. In the FIG. 11 embodiment, a laser 422 is disposed above the mill in position for providing a substantially continuous concentrated light beam 428 which reflects upon mirror 429, straight downwardly in the direction of the log. Underneath the log carriage 26 is a bank 430 of photosensitive diode receivers located at relatively closely spaced intervals, e.g. at eighth inch intervals, being disposed in a line extending transversely of the mill and directly below the travel path of mirror 429. Mirror 429 is secured by support 433 upon the operating rod 426 of air cylinder 424 which is adapted for moving the mirror horizontally for the length of the bank 430 of photosensitive diode receivers therebelow. As a consequence, when air cylinder 424 is operated forwardly, moving the mirror 429 from an extremely retracted position, in a path across the log, the beam 428 from laser 422 will successively strike the photosensitive diode receivers in order. Since a log is located over the carriage, certain of the photosensitive diode receivers will receive the light from the laser beam and others will not. Thus, as the mirror starts out from its extremely retracted position with support 433 therefor in nearly abutting relation to the cylinder 424, relatively rapid movement of the mirror to the left by the air cylinder will activate photosensitive diode receivers in order in bank 430 until the beam reaches a side of the log, after which a sequence of such photosensitive diode receivers would lie in the shadow of the log. Of course, as the reflected light beam reaches the opposite side of the log, photosensitive diode receivers will again be actuated. The photosensitive diode receivers are connected in common to provide a pulse output when the light beam strikes each receiver, and as in the case of the previous embodiment, the diameter of the log is the inverse function of the number of pulses, here from photosensitive diode bank 430. The measurement procured is applied to data processing circuitry in substantially the same manner as hereinbefore described in connection with the prior embodiment. After the measurement has taken place, the operating rod 426 of air cylinder 424 is retracted for returning mirror 429 to the right.

Although only one such calipering apparatus is strictly necessary, it is desired the calipering apparatus be duplicated along the log, e.g. at each end thereof, and the smaller calipered output corresponding to the smaller end of the log can be selected (by feeding in the largest count to the data processing circuitry) and utilized as the correct log diameter.

In response to the log diameter measurement, various "sets" for cutting means (similar to those hereinbefore described) are supplied by the aforementioned data processing circuitry. Furthermore, backstand sets are also determined substantially as in the case of the prior embodiment. In the instance of the FIG. 11 embodiment, the backstand means is also optical and electronic, comprising a first bank consisting of a line of lamp bulbs 432, located above the mill carriage, in transverse relation thereto, and a first bank of photosensitive diode receivers 434 immediately therebelow. Each of the lamp bulbs of bank 432 is provided with a lens for imaging the light produced onto only one of the photosensitive diodes of bank 434 therebelow. Both the lamp bulbs and the photosensitive diodes are suitably disposed at $\frac{1}{8}$ inch intervals.

After a particular backstand setting is determined, one of the lamp bulbs of bank 432 is activated, according to desired backstand setting, i.e. according to the desired distance the forward side of the log should be from the mill center line. Then, the log is moved from left to right, as viewed in FIG. 11, until the beam from that lamp bulb is broken, as indicated by the output from the corresponding photosensitive diode in alignment therewith. It should be noted that there are at least a pair of backstands, one for each of the charger means as in the prior embodiment, and hence the backstand devices will be located in spaced relation along the carriage with each one suitably disposed approximately opposite its own charger means which will be stopped when the forward log side reaches the backstand light beam position.

In order to bring about charging of the log toward the backstand, both charging beams are first moved to the left through operation of cylinder 414. The support structure 406 for first charger beam 407 and the support structure 408 for second charger beam 409 are in turn supported by beams 420 mounted upon a slideable shaft 440 which connects beams 420. Shaft 440 is slideably supported in bearings 442 upon lower beam structure 444, to which the left hand end of cylinder 414 may be mounted. The operating rod of cylinder 414 is pivotally connected to the shaft 440. The cylinder 414 comprises a twin cylinder structure having pneumatic means for moving the operating rod thereof to the left, and hydraulic means for moving the operating rod thereof more slowly to the right. The control cycle of this cylinder begins by operating the same pneumatically to the left as an air cylinder, whereby the entire charger support structure 406, 408 slides to the left, away from the mill center line, carrying the measured log therewith. Then, cylinder 414 is moved to the right, hydraulically, at a comparatively slow rate. When the log intersects the beam from one of the lamp bulbs of bank 432, the hydraulic supply is disabled to the corresponding charger cylinder and the corresponding charger stops. Then, the log can be dogged as hereinbefore described, and cylinders 410 and 412 are operated to withdraw charger beams 407 and 409 from the log so the carriage can move in the hereinbefore described manner for sawing the log. The apparatus of FIG. 11 has advantages in handling heavier, longer and/or larger diameter logs, and the charging and calipering operations are more rapid. For sawing logs larger in diameter than sixteen inches, the hereinbefore described program is expanded observing similar criteria therefor. Also, a greater number of band saws may be directed thereby.

While we have shown and described preferred embodiments of out invention, it will be apparent to those skilled in the art that many changes and modifications may be made without departing from our invention in its broader aspects. We therefore intend the appended claims to cover all such changes and modifications as fall within the true spirit and scope of our invention.

We claim:

1. In a sawmill, a carriage for receiving a log, dogging means provided on said carriage at positions proximate the ends of said log for engaging said log, said dogging means having a width dimension adapting the same for carrying the log through a sawmill, a pair of charger means operative in a forward direction toward said carriage from a side thereof for carrying said log to said carriage, said charger means of said pair being positioned at spaced locations along said log and each said charger means being movable relative to the other for moving said log by different transverse distances toward said carriage at said spaced locations to place a side of said log substantially parallel to the direction of movement of said carriage, measuring means for ascertaining the diameter of said log and the corresponding forward movement of said charger means for predetermined sawing of said log, backstand means adjacent the carriage and substantially against which said log is charged for interrupting movement of the respective charger means, said backstand means being movable laterally of said carriage for positioning of said log relative to said carriage according to the diameter of said log with a side of said log substantially parallel to the direction of movement of said carriage, and means for operating at least one of said dogs for engaging said log after positioning thereof with respect to said backstand means.

2. In a sawmill, a carriage means for receiving a log, plural charger means for transporting a log to a position relative to said carriage, said charger means each comprising a pair of charger beams movable inwardly and outwardly toward and away from one another in a direction transverse to said carriage and on each side thereof, means for simultaneously moving said charger beams on each side of the carriage in a first transverse direction for moving a log in a first direction, and means for simultaneousl moving the charger beams on each side o the carriage in a second direction transverse to said carriage for positioning said log, said charger means each being substantially independent for executing differing movements in said second direction for changing the angular orientation of said log relative to said carriage to align a side of said log with the direction of movement of said carriage.

3. In a sawmill, carriage means for receiving a log and transporting the same in a longitudinal direction for sawing, said carriage means having means for engaging ends of said log, a pair of charger means operative in a forward direction toward said carriage means from a side thereof for carrying said log to said carriage means, each said charger means of said pair being substantially independent for executing differing forward movement for changing the angular orientation of said log, measuring means for ascertaining the diameter of said log and the corresponding forward movement of said charger means for predetermined sawing of said log and backstand means automatically operated by said log for determining the angular orientation of said log to position said log with a side thereof parallel to the direction of longitudinal movement of said carriage means, and means for interrupting movement of said charger means when the desired forward movement and angular orientation is reached such that said engaging means can engage said log.

4. The apparatus according to claim 3 wherein said backstand means comprises switch operating fingers.

5. The apparatus according to claim 3 wherein said backstand comprises light emitting means and means for detecting interruption of the light by said log.

6. The apparatus according to claim 3 wherein said charger means of said pair are operative to move at substantially the same rate toward said carriage means, said charger means being responsive to said backstand means for arresting motion of one of said charger means before the other charger means to provide said angular orientation.

7. The apparatus according to claim 3 including a backstand means for each of said pair of charger means, a charger means being aligned with and responsive to the corresponding backstand means for arresting motion of such charger means when the desired log position is reached with one side of said log parallel to the direction of longitudinal movement of said carriage means.

8. The apparatus according to claim 3 wherein each of said charger means comprises a beam, and a pivotal front cradle for moving said log toward said carriage means and allowing withdrawing of said charger beams away from said carriage means after pivoting of said cradles for releasing said log.

9. In a sawmill, means including a saw for sawing a log and means for producing relative longitudinal movement between said saw and said log for sawing said log producing a saw line in a longitudinal direction, plural charger means for initially carrying said log in a direction substantially transverse to said longitudinal direction and forward toward said saw line for subsequent engagememnt by said saw, said charger means of said pair being positioned at spaced locations along said log and being movable relative to one another for moving said log by different transverse distances at said spaced locations, means for measuring the diameter of said log and means for automatically determining the differential transverse positioning at said spaced locations as will locate said log in a predetermined angular orientation relative to said longitudinal direction for positioning a side of said log in parallel relation to said longitudinal direction, and means for energizing said charger means for executing differing transverse movement to provide said differential positioning to angularly align said log for sawing and forward movement in accordance with the diameter of said log.

10. The apparatus according to claim 9 wherein said means for determining the differential transverse movement includes photoelectric means for detecting the side of said log for positioning said side in parallel relation to said longitudinal direction.

11. The apparatus according to claim 9 wherein said means for determining the differing transverse movement and said means for measuring the diameter of said log comprise photoelectric means for measuring said log.

12. In a sawmill, carriage means for receiving a log, a pair of charger means operative in a direction toward and away from said carriage means for transporting said log to said carriage means, means for measuring the diameter of said log, and backstand means operated by said log for detecting the proper position of said log and for interrupting movement of said charger means, including means for positioning said backstand means in accordance with the diameter of said log.

13. The apparatus according to claim 12 wherein said means for measuring the diameter includes a mechanical arm, means for moving the arm toward a log, and means for detecting the extent of movement required to contact the log.

14. The apparatus according to claim 12 wherein said means for measuring the diameter includes means for scanning the log by a light beam, and means for indicating the extent of scanning interruption by the log.

15. In a sawmill, means including a saw for sawing a log and means for providing relative longitudinal movement between said saw and said log for sawing said log producing a saw line in a longitudinal direction, plural charger means for initially carrying said log in a direction substantially transverse to said longitudinal direction and forward toward said saw line for subsequent engagement by said saw, said charger means of said pair being positioned at spaced locations along said log and being substantially independent from one another for moving said log by different transverse distances at said spaced locations, means separate from said charger means for automatically determining the differential transverse positioning at said spaced locations as will locate said log with a predetermined angular orientation relative to said longitudinal direction for positioning a side of said log in parallel relation to said longitudinal direction, and means for energizing said charger means for executing differing transverse movement to provide said differential positioning to angularly align said log for sawing with a side of said log in parallel relation to said longitudinal direction.

* * * * *